US005646661A

United States Patent [19]

Asai et al.

[11] Patent Number: 5,646,661

[45] Date of Patent: Jul. 8, 1997

[54] INK EJECTING DEVICE HAVING ALTERNATING EJECTING CHANNELS AND NON-EJECTING CHANNELS

[75] Inventors: Hiroki Asai, Aichi-ken, Japan; Qiming Zhang, Westford, Mass.; Hiroto Sugahara, Aichi-ken, Japan

[73] Assignee: Brother Kogyo Kabushiki Kaisha, Nagoya, Japan

[21] Appl. No.: 323,721

[22] Filed: Oct. 18, 1994

[30] Foreign Application Priority Data

Nov. 11, 1993 [JP] Japan ..... 5-282369
Jan. 26, 1994 [JP] Japan ..... 6-007104

[51] Int. Cl.[6] ..... B41J 2/045

[52] U.S. Cl. ..... 347/69; 347/68; 347/71

[58] Field of Search ..... 347/69, 94, 71, 347/68

[56] References Cited

U.S. PATENT DOCUMENTS

| | | | |
|---|---|---|---|
| 3,946,398 | 3/1976 | Kyser et al. | 347/70 |
| 4,536,097 | 8/1985 | Nilsson | 347/71 |
| 4,723,129 | 2/1988 | Endo et al. | 347/56 |
| 4,842,493 | 6/1989 | Nilsson | 347/68 X |
| 4,879,568 | 11/1989 | Bartky et al. | 347/69 |
| 5,016,028 | 5/1991 | Temple | 347/69 |
| 5,432,540 | 7/1995 | Hiraishi | 347/69 |
| 5,477,247 | 12/1995 | Kanegae | 347/20 |

FOREIGN PATENT DOCUMENTS

| | | |
|---|---|---|
| 484 983 | 5/1992 | European Pat. Off. . |
| 2 264 086 | 8/1993 | United Kingdom . |
| 2 265 113 | 9/1993 | United Kingdom . |

*Primary Examiner*—Benjamin R. Fuller
*Assistant Examiner*—Charlene Dickens
*Attorney, Agent, or Firm*—Oliff & Berridge

[57] ABSTRACT

An ink ejecting device includes ink channels intercommunicating with slits and air channels intercommunicating with another slits. The ink channels and the air channels have a narrow shape with a rectangular cross-section, and all of the ink channels are filled with ink and the air channels are filled with air. An LSI chip applies a voltage V to a pattern conducting to metal electrodes positioned in air channels located at both sides of an ink channel from which the ink is to be ejected and connects the other patterns connected to metal electrodes in other air channels not adjacent the ejecting ink channel and a pattern conducting to the metal electrodes of the non-ejecting ink channels to a ground line. Therefore, the ink ejecting device of the above structure requires no insulation between ink and electrodes as the working electrodes do not contact the ink.

23 Claims, 17 Drawing Sheets

INK EJECTING DEVICE HAVING ALTERNATING EJECTING CHANNELS AND NON-EJECTING CHANNELS

BACKGROUND OF THE INVENTION

1. Field of the Invention

The invention relates to an ink ejecting device.

2. Description of Related Art

Of non-impact type printing devices which have recently taken the place of conventional impact type printing devices and have greatly propagated in the market, ink-ejecting type printing devices have been known as being operated on the simplest principle and as being effectively used to easily perform multi-gradation and coloration. Of these devices, a drop-on-demand type for ejecting only ink droplets which are used for printing has rapidly propagated because of its excellent ejection efficiency and low running cost.

The drop-on-demand types are representatively known as a Kyser type, as disclosed in U.S. Pat. No. 3,946,398, or as a thermal ejecting type, as disclosed in U.S. Pat. No. 4,723,129. The former, or Kyser type, is difficult to design in a compact size. The latter, the thermal ejecting type requires the ink to have a heat-resistance property because the ink is heated at a high temperature. Accordingly, these devices have significant problems.

A shear mode type printer, as disclosed in U.S. Pat. No. 4,879,568, has been proposed as a new type to simultaneously solve the above disadvantages.

As shown in FIGS. 10A and 10B, the shear mode type of ink ejecting device 600 comprises a bottom wall 601, a ceiling wall 602 and a shear mode actuator wall 603 therebetween. The actuator wall 603 comprises a lower wall 607 which is adhesively attached to the bottom wall 601 and polarized in the direction indicated by an arrow 611. An upper wall 605 is adhesively attached to the ceiling wall 602 and polarized in the direction indicated by an arrow 609. A pair of actuator walls 603 thus formed forms an ink channel 613 therebetween. A space 615 which is narrower than the ink channel 613 is also formed between neighboring pairs of actuator walls 603 in an alternating relationship to the ink channels 613.

A nozzle plate 617, having nozzles 618 formed therein, is fixedly secured to one end of each ink channel 613, and electrodes 619 and 621 are provided as metallized layers on both side surfaces of each actuator wall 603. Each of the electrodes 619,621 is covered by an insulating layer (not shown) to insulate it from the ink. The electrodes 619,621 which face the space 615 are connected to a ground 623, and the electrodes 619,621 which are provided in the ink channel 613 are connected to a silicon chip 625 which forms an actuator driving circuit.

Next, a manufacturing method for the ink ejecting device 600 as described above will be described. First, a piezoelectric ceramic layer, which is polarized in a direction as indicated by an arrow 611, is adhesively attached to the bottom wall 601 and a piezoelectric ceramic layer, which is polarized in a direction as indicated by an arrow 609, is adhesively attached to the ceiling wall 602. The thickness of each piezoelectric ceramic layer is equal to the height of each of the lower walls 607 and the upper walls 605. Subsequently, parallel grooves are formed on the piezoelectric ceramic layers by rotating a diamond cutting disc or the like to form the lower walls 607 and the upper walls 605. Further, the electrodes 619 are formed on the side surfaces of the lower walls 607 by a vacuum-deposition method, and the insulating layer, as described above is provided onto the electrodes 619. Likewise, the electrodes 621 are provided on the side surfaces of the upper walls 605 and the insulating layer is further provided on the electrodes 621.

The vertex portions of the upper walls 605 and the lower walls 607 are adhesively attached to one another to form the ink channels 613 and the spaces 615. Subsequently, the nozzle plate 617, having the nozzles 618 formed therein, is adhesively attached to one end of the ink channels 613 and the spaces 615 so that the nozzles 618 face the ink channels 613. The other end of the ink channels 613 and the spaces 615 is connected to the silicon chip 625 and the ground 623.

A voltage is applied to the electrodes 619,621 of each ink channel 613 from the silicon chip 625, whereby each actuator wall 603 suffers a piezoelectric shear mode deflection in such a direction that the volume of each ink channel 613 increases. The voltage application is stopped after a predetermined time elapses, and the volume of each ink channel 613 is restored from a volume-increased state to a natural state, so that the ink in the ink channels 613 is pressurized and an ink droplet is ejected from the nozzles 618.

However, in the ink ejecting device 600 constructed as described above, the electrodes 619,621 facing the spaces 615 are connected to the ground 623 and the electrodes 619,621 provided in the ink channels 613 are connected to the silicon chip 625 forming the actuator driving circuit so that the voltage is applied to the electrodes 619,621 in each ink channel 613 to eject the ink. Therefore, the electrodes 619,621 in the ink channels 613 must be coated with the insulating layer to be insulated from the ink. If no insulating layer is provided, short-circuiting would occur for the highly conductive ink. Further, even if conductivity of the ink is not so high, the electrodes 619,621 are deteriorated due to electrical or chemical corrosion thereof and thus deflection of the actuator wall 603 is not sufficiently performed so that printing quality is lowered. Accordingly, the insulating layer must be provided to insulate the ink and the electrodes 619,621 from each other and equipment and a process for forming the insulating layer are required. As a result, there occurs a problem that productivity is lowered and cost is increased.

In U.S. Pat. No. 4,879,568 disclosing the ink ejecting device 600, ink is provided only to the ink channels 613. No ink is provided to the spaces 615. However, the structure and method for supplying the ink to this multi-channel ink ejecting device are not disclosed. If it is considered that through holes intercommunicating with the ink channels 613 are provided at the bottom wall 601 or the ceiling wall 602 in correspondence with the respective ink channels 613 to supply the ink into the ink channels 613 while preventing the supply of ink into the spaces 615, it is difficult to form the through holes because of the small size and the yield is low. In addition, the processing or assembly work requires a long time and is unsuitable for mass production.

There has been recently proposed another ink ejecting device as disclosed in U.S. Pat. No. 5,016,028, which can perform higher integration and miniaturization by using a shear mode (thickness shear mode) in deflection modes of piezoelectric material for the occurrence of pressure. The construction of this ink ejecting device will be hereunder described with reference to the accompanying drawings.

As shown in FIG. 11, the ink ejecting device 1 comprises a piezoelectric ceramic plate 2, a cover plate 3, a nozzle plate 31 and a base plate 41.

The piezoelectric ceramic plate 2 is formed of ceramic material of lead zirconate titanate (PZT) having ferroelectricity. The piezoelectric ceramic plate 2 is polarized in the direction indicated by arrow 5. It is then subjected to cutting using a rotating diamond blade 30 to form grooves 28 therein as shown in FIG. 12. During the cutting, the cutting direction of the diamond blade 30 is varied from a direction 30A through a direction 30B to 30C, thereby forming a groove 28 comprising a channel groove portion 17, an arc-shaped groove 19 and a shallow groove portion 16.

The channel groove portion 17 is formed by cutting in the direction 30A by the diamond blade 30. Then the cutting direction is varied from the direction 30A to the direction 30B to change the depth of the cutting work. At this time, the arc-shaped groove portion 19, which is a curved surface having the same curvature as the diamond blade 30, is formed. Subsequently, the cutting direction is varied from the direction 30B to the direction 30C to form the shallow groove portion 16.

As shown in FIG. 11, plural grooves 28 are formed on the piezoelectric ceramic plate 2 which has been subjected to cutting as described above. The grooves 28 have the same depth and are arranged in parallel to one another. The shallow groove portion 16 is formed in the neighborhood of one end surface 15 of the piezoelectric ceramic plate 2. The dimensions of the channel groove portion 17 and the shallow groove portion 16 is determined by the thickness and the cutting depth of the diamond cutter blade 30. The pitch and the number of the grooves 28 is determined by controlling the feeding pitch of a working table and the frequency of groove cutting in the process of forming the grooves 28. The curvature of the curved surface of the arc-shaped groove portion 19 is determined by the diameter of the diamond blade 30. This method is used in semiconductor manufacturing and, needless to say, this method is an effective technique which is usable to perform high integration, etc. required for the ink ejecting device because extremely thin diamond blades of about 0.02 mm thickness are sold in the market. Partition walls 11, which serve as the side surfaces of the grooves 28, are polarized in the direction indicated by the arrow 5.

Metal electrodes 13, 18 and 9 are deposited on the side surfaces of the channel groove portion 17 and the arc-shaped groove portion 19 and the inner surface of the shallow groove portion by a deposition method. As shown in FIG. 13, during the formation of the metal electrodes 13, 18 (FIG. 11) and 9, the piezoelectric ceramic plate 2 is inclined with respect to the vapor emitting direction of a deposition source (not shown). Upon emission of metal vapor from the deposition source, the metal electrodes 13, 18, 9 and 10 are formed at the upper half portion of the side surface of the channel groove portion 17, at a portion from the upper portion of the side surface of the arc-shaped groove portion 19 to a half portion of the side surface of the channel groove portion 17, on the inner surface of the shallow portion 16 and on the upper surface of the partition wall 11 by a shadow effect of the partition walls 11. Subsequently, the piezoelectric ceramic plate 2 is rotated by 180 degrees, whereby the remainder of the metal electrodes 13, 18, 9 and 10 are formed in the same manner as described above. Thereafter, the unnecessary metal electrode 10 which is formed on the upper surface of the partition wall 11 is removed by a lapping method or the like. Through this process, the metal electrode 13 is formed on both side surfaces of the channel groove portion 17 and is electrically connected to the metal electrode formed on the inner surface of the shallow groove portion 16 through the metal electrode 18 formed on the side surface of the arc-shaped groove portion 19.

The cover plate 3 shown in FIG. 11 is formed of a ceramic or a resin material. An ink inlet port 21 and a manifold 22 are formed in the cover plate 3 by grinding or cutting. Thereafter, the surface of the piezoelectric ceramic plate 2 on which the grooves 28 are formed and the surface of the cover plate 3 on which the manifold 22 is formed are adhesively attached to each other with adhesive agent 4 of epoxy group (FIG. 15) or the like. Accordingly, the upper surfaces of the grooves 28 are covered by the cover plate 3, and plural ink channels 12 (FIG. 15) which are arranged at a predetermined interval in a lateral direction are formed in the ink ejecting device 1. Subsequently, ink is filled into all the ink channels 12.

The end surfaces of the piezoelectric ceramic plate 2 and the cover plate 3 are adhesively attached to a nozzle plate 31 in which nozzles 32 are formed so as to confront the respective ink channels. The nozzle plate 31 is formed of plastic such as polyalkylene (for example, ethylene) terephthalate, polyimide, polyether imide, polyether ketone, polyether sulfone, polycarbonate, cellulose acetate or the like.

The base plate 41 is adhesively attached using an adhesive agent of the epoxy group to the surface of the piezoelectric ceramic plate 2 which is opposite to the surface on which the grooves 28 are formed. The base plate 41 is formed with conductive-layer patterns 42 at the positions corresponding to the respective ink channels. The conductive-layer patterns 42 and the metal electrode 9 on the shallow groove portion 16 are connected to each other through a wiring 43 by a well-known wire bonding method or the like.

Next, the structure of the control unit will be described with reference to FIG. 14. FIG. 14 is a block diagram showing the control unit. The conductive-layer patterns 42 formed on the base plate 41 are individually connected to an LSI chip 51. A clock line 52, a data line 53, a voltage line 54 and a ground line 55 are also connected to the LSI chip 51. On the basis of sequential clock pulses supplied from the clock line 52, the LSI chip 51 determines in accordance with data appearing on the data line 53, which nozzle 32 should eject ink droplets. On the basis of this judgment, the LSI chip 51 applies a voltage V from the voltage line 54 to a conductive-layer pattern 42 which is electrically connected to the metal electrode 13 of an ink channel 12 to be driven, and connects the ground line 55 to the conductive-layer patterns 42 which are electrically connected to the metal electrodes 13 of the ink channels 12 other than the ink channel 12 to be driven.

Next, the operation of the ink ejecting device will be described with reference to FIGS. 15 and 16.

In accordance with prescribed data, the LSI chip 51 judges that the ink is ejected from an ink channel 12B of the ink ejecting device 1. On the basis of this judgment, a positive driving voltage V is applied to the metal electrodes 13E and 13F through the conductive-layer pattern 42; the metal electrode 9 and the metal electrode 18 which correspond to the ink channel 12B, and the metal electrodes 13D and 13G are grounded. At this time, a driving electric field, directed as indicated by arrow 14B, occurs in the partition wall 11B and a driving electric field directed as indicated by arrow 14C occurs in the partition wall 11C. In this case, the directions 14B and 14C of the driving electric fields are perpendicular to the polarization direction 5, so that the partition walls 11B and 11C are rapidly deflected toward the inner side of the ink channel 12B due to an effect of the piezoelectric thickness shear mode. Through this deflection, the volume of the ink channel 12B is reduced, and the ink pressure rapidly increases so that a pressure wave occurs, and the ink droplet is ejected from the nozzle 32 (FIG. 11) which intercommunicates with the ink channel 12B.

Further, when the application of the driving voltage V is stopped, the partition walls 11B and 11C are returned to their original position before deflection (see FIG. 15), and the ink pressure in the ink channel 12B is reduced so that the ink is supplied from the ink inlet port 21 (FIG. 11) through the manifold 22 (FIG. 11) into the ink channel 12B.

In the ink ejecting device as described above, the partition walls 11B and 11C at both sides of the ink channel 12B are deflected (deformed) to eject the ink from the ink channel 12B as shown in FIG. 16. However, a portion of the partition wall 11 which corresponds to the side surface of the arc-shaped groove portion 19 is little deflected. Therefore, deflection of a portion of the partition wall 11 which corresponds to the side surface of the channel groove portion 17 contributes to the occurrence of the ink pressure for ink ejecting. That is, the ink filled in the channel groove portion 17 is pressurized, and ink droplet having a predetermined volume is ejected from the nozzle 32 at a prescribed ejecting velocity. Thus, the pressure occurrence which contributes to the ejecting is induced at the channel groove portion 17. The shallow groove portion 16 and the arc-shaped groove portion 19 do not contribute to the pressure occurrence.

Accordingly, there is a problem that the cost of the piezoelectric material for the shallow groove portion 16 and a portion of the arc-shaped groove portion 19 for forming the shallow groove portion 16 for electrical connection with the patterns 42 of the base plate 41, and the material cost of the piezoelectric ceramic plate are high.

Here, electrically, the piezoelectric material constituting the partition walls 11 serves as a kind of capacitor. Therefore, the shallow groove portion 16 and the arc-shape groove portion 19 which substantially do not contribute to the occurrence of pressure are also formed of piezoelectric material. Accordingly, there is a problem that the electrostatic capacity as the capacitor is increased, and thus the efficiency of energy consumed for the pressure occurrence to electrical input energy is low.

SUMMARY OF THE INVENTION

An object of the invention is to provide an ink ejecting device in which no insulation is required between ink and electrodes.

Another object of the invention is to provide an ink ejecting device requiring no insulation layer for insulating ink and electrodes from each other, having high productivity and being highly suitable for mass production.

Another object of the invention is to provide an ink ejecting device requiring a small amount of piezoelectric ceramic material and having high energy efficiency.

In order to attain the above objects, an ink ejecting device is provided comprising a plurality of ejecting regions through which ink is ejected, a plurality of non-ejecting regions each of which is provided between said ejecting regions alternately, partition walls which are formed of a polarized piezoelectric ceramic material and provided between one of the plurality of ejecting regions and one of the plurality of non-ejecting regions and first electrodes which are formed on the partition walls for generating an electric field in the piezoelectric ceramic material in accordance with a voltage applied thereto, wherein the first electrodes formed on the partition walls facing the ejecting regions are grounded and the first electrodes formed on the partition walls facing the non-ejecting regions are supplied with a voltage.

In addition, an ink ejecting device is provided comprising a plurality of ink channels, a plurality of partition walls forming the ink channels and at least a portion of the partition walls is formed of a piezoelectric ceramic material, a plurality of first electrodes formed on the piezoelectric ceramic material of the partition walls, first communicating portions, each of which communicates with each of the ink channels and a plurality of second electrodes provided on a portion of the first communicating portions and a portion of the ink channels, the second electrodes being electrically connected to the first electrodes provided on the piezoelectric material facing the ink channels.

Further, an ink ejecting device is provided comprising a plate at least a part of which is formed of a piezoelectric ceramic material, a plurality of first grooves formed on a first surface of the plate, a cover plate provided on the first surface of the plate, a plurality of first electrodes formed on at least a portion of side surfaces of the plurality of first grooves, a second electrode for electrically connecting all of the first electrodes in the first grooves, a plurality of second grooves each of which is formed between the plurality of first grooves alternately on a second surface opposite to the first surface of the plate, a plurality of third electrodes which are formed on at least a portion of side surfaces of the plurality of second grooves, connection means for individually and electrically connecting at least two of the third electrodes formed on the side surfaces of the plurality of second grooves and sandwiching one of the first grooves and a manifold provided on the first surface of the plate, the manifold for supplying ink to the plurality of first grooves, wherein a voltage is applied to the plurality of third electrodes and the plurality of first electrodes are grounded, thereby deforming the piezoelectric ceramic material on the side surfaces of the plurality of first grooves, whereby the ink supplied from the manifold is ejected from the first grooves.

In the ink ejecting device according to the invention thus structured, the first electrodes in the ejecting regions are grounded, and the voltage is applied to the first electrodes in the non-ejecting regions, whereby the ink is ejected from the ejecting regions.

As is apparent from the foregoing, according to the ink ejecting device of the invention, the first electrodes in the ejecting regions are grounded and the first electrodes in the non-ejecting regions are supplied with the voltage to eject the ink from the ejecting regions. Therefore, no voltage is applied to the electrodes of the ejecting regions and, thus, these electrodes are hardly deteriorated. Accordingly, unlike the prior art, no insulation layer for insulating the ink and the electrodes is required and, thus, no equipment and process therefor are required so that the productivity can be improved and the cost can be reduced. Further, as no voltage is applied to the electrodes of the ejecting regions, the electrodes have excellent anticorrosion resistance. Therefore, the electrodes have high durability and the life of the ink ejecting device is lengthened.

Further, the first grooves are processed from one surface of the plate, and the second grooves are processed from the other surface of the plate so that the manifold for supplying the ink to the first grooves can be designed in a simple shape, the processing work is simplified and the mass production is facilitated.

Further, as a plurality of the first communicating portions communicate with a plurality of the ink channels and the second electrodes formed on at least a part of the inner surface of the first communicating portions and on a portion of the ink channels adjacent the first communicating portions are connected electrically with the first electrodes, the arc-shaped groove portion and the shallow groove portion formed of a piezoelectric material are not required. Therefore, the amount of required piezoelectric ceramics material and the cost can be reduced. Further, the electrostatic capacity of the ink ejecting apparatus becomes smaller and the energy efficiency is much better than the related art.

BRIEF DESCRIPTION OF THE DRAWINGS

Preferred embodiments of the invention will be described in detail with reference to the following figures in which.

DETAILED DESCRIPTION OF THE PREFERRED EMBODIMENTS

Preferred embodiments according to the invention will be hereunder described with reference to the accompanying drawings.

Figure 1:
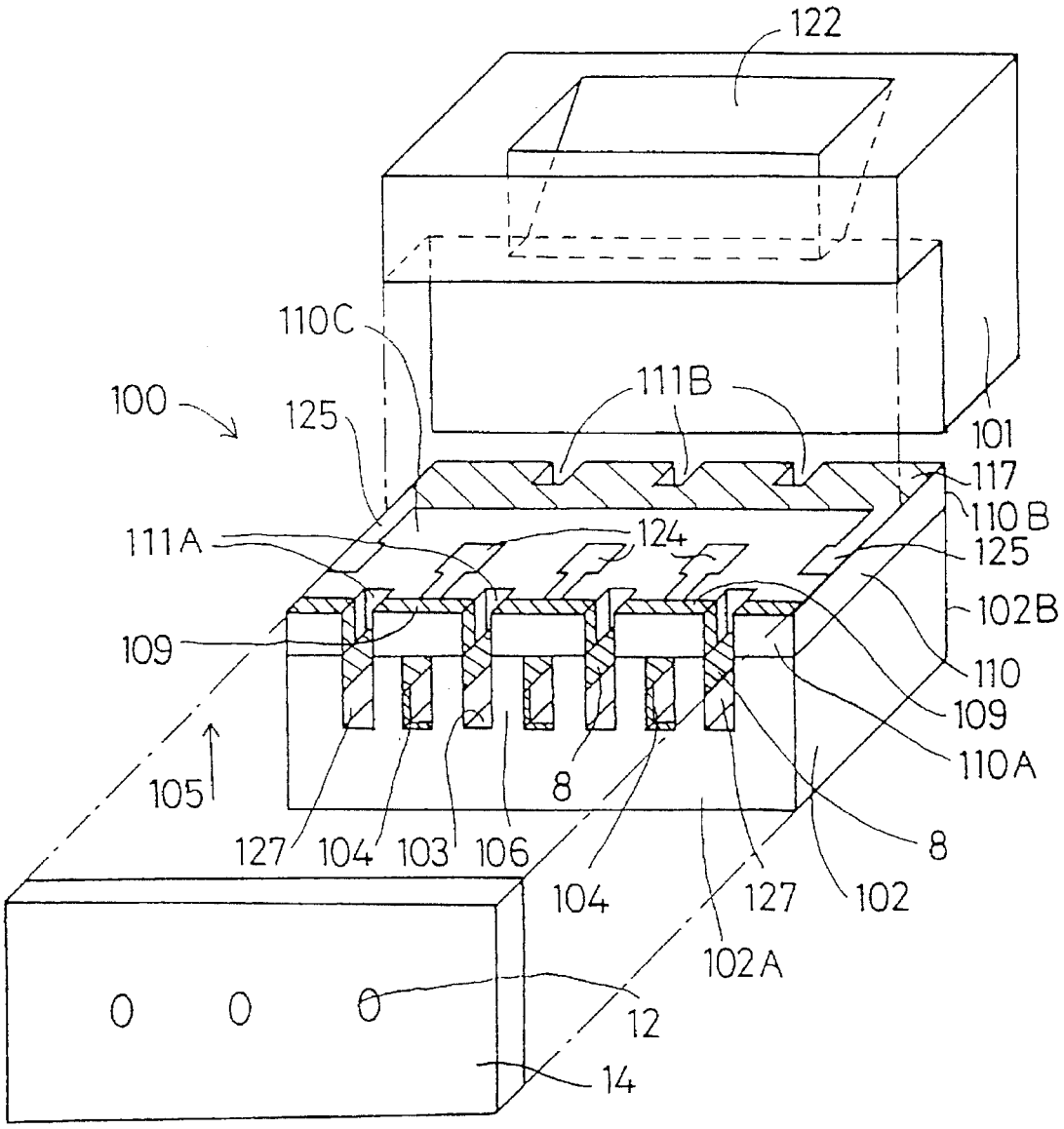
FIG. 1 is a perspective view showing an ink ejecting device according to the first embodiment.

As shown in FIG. 1, the ink ejecting device 100 comprises a piezoelectric ceramic plate 102, a cover plate 110, a nozzle plate 14 and a manifold member 101.

The piezoelectric ceramic plate 102 is formed of ceramic material of lead zirconate titanate group (PZT). A plurality of grooves 103 are formed on the piezoelectric ceramic plate 102 by a cutting using a diamond blade or the like. Partition walls 106, which serve as the side surfaces of the grooves 103, are polarized in a direction as indicated by an arrow 105. The grooves 103 are designed to have the same depth and to be in parallel to one another so as to be opened at both end surfaces 102A and 102B of the piezoelectric ceramic plate 102. A metal electrode 8 is formed at an upper half portion of both side surfaces of the inner surface of each groove 103 by a sputtering or other method.

The cover plate 110 is formed of alumina, and slits 111A and 111B are formed on the facing end surfaces 110A and 110B thereof, respectively. The pitch of the slits 111A, 111B is set to two times the pitch of the grooves 103 and the slits 111A and 111B are alternately arranged so as deviate from one another by a half pitch. The slits 111A,111B are therefore provided in correspondence with the grooves 103. Further, patterns 124 and 125 are formed on the surface 110C of the cover plate 110.

Figure 3A:
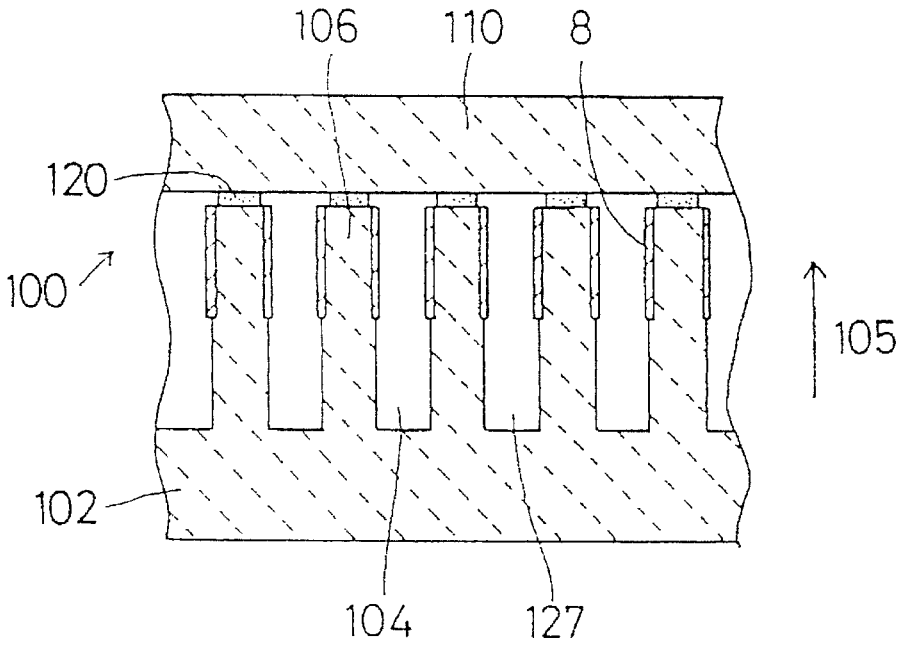
FIG. 3A is a schematic view showing the operation of the ink ejecting device of the first embodiment.
Figure 3B:
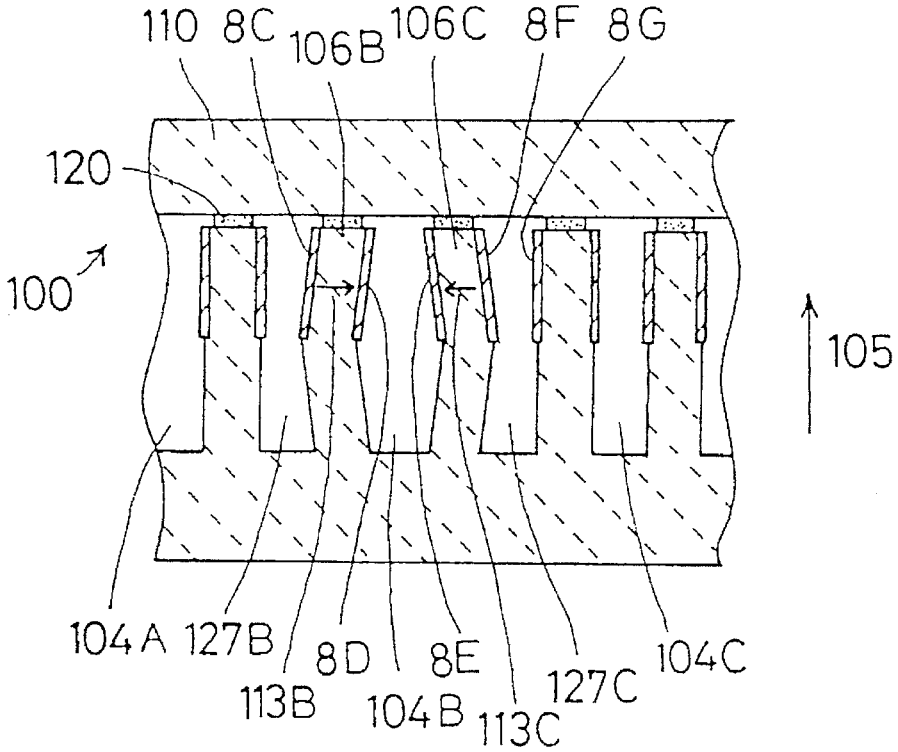
FIG. 3B is a schematic view showing the operation of the ink ejecting device of the first embodiment.

Thereafter, the surface of the piezoelectric ceramic plate 102, on which the grooves 103 are processed, is adhesively attached to the surface opposite to the surface 110C of the cover plate 110 with epoxy-based adhesive agent 120 (FIG. 3). Accordingly, in the ink ejecting device 100 are formed ink channels 104, from a portion of the grooves 103, serving as ejecting channels which intercommunicate with the slits 111B, and air channels 127, from the remaining grooves 103, serving as non-ejecting areas which intercommunicate with the slits 111A. The ink channels 104 and the air channels 127 are narrow and have a rectangular cross-section. Ink is filled in the ink channels 104 and air is filled in the air channels 127.

After the adhesion of the cover plate 110, a metal electrode 109 is formed on an area located on the surface 110C of the cover plate 110 at the end surface 110A side from the bottom surface of the slits 111A and at a part of the side surface of the inner surface of each slit 111A. At this time, the metal electrode 109 is also formed on the metal electrode 8 of each air channel 127 intercommunicating with a slit 111A. Thus, the metal electrodes 8 of each air channel 127 are electrically connected to the metal electrodes 109 formed on the side surfaces of the slits 111A. Therefore, a metal electrode 8 (see electrode 8C of FIG. 3B) formed on a partition wall 106 (see partition wall 106B of FIG. 3B) which is located at one side of an air channel 127 (see air channel 127B of FIG. 3B) to partially define an ink channel 104 (see ink channel 104B of FIG. 3B), is electrically connected to a metal electrode 8 (see electrode 8F of FIG. 3B) formed on another partition wall 106 (see partition wall 106C of FIG. 3B), which is located at one side of another air channel 127 (see air channel 127C of FIG. 3B) and completes the definition of the ink channel 104 (see ink channel 104B of FIG. 3B) which is sandwiched between the two partition walls 106 (see partition walls 106B, 106C of FIG. 3B). The metal electrodes 109 are electrically connected to the patterns 124.

Further, a metal electrode 117 is formed at an area located on the surface 110C extending from approximately the middle of the cover plate 110 to the end surface 110B side, of the surface 110C of the cover plate 110, and over the inner surface of each slit 111B. The metal electrode 117 is also formed on the metal electrode 8 of each ink channel 104 intercommunicating with the slit 111B. Thus, the metal electrode 8 is also electrically connected to the metal electrode 117 formed on the side surface of the slit 111B.

Therefore, the metal electrodes 8 of all the ink channels 104 are electrically connected to one another through the metal electrode 117. The metal electrode 117 is electrically connected to the pattern 125. The end surfaces 102A and 102B of the piezoelectric ceramic plate 102 and the end surfaces 110A and 110B of the cover plate 110 are masked so that no metal electrodes 109 and 117 are formed on these end surfaces.

A nozzle plate 14 having nozzles 12 which are located at positions corresponding to the ink channels 104 is adhesively attached to the end surface 102A of the piezoelectric ceramic plate 102 and the end surface 110A of the slit ilia side of the cover plate 110. The nozzle plate 14 is formed of plastic material such as polyalkylene (for example, ethylene) terephthalate, polyimide, polyether imide, polyether ketone, polyether sulfone, polycarbonate, cellulose acetate or the like.

Thereafter, the manifold member 101 is adhesively attached to the end surface 102B of the piezoelectric ceramic plate 102, the end surface 110B of the cover plate 110 and the surface 110C of the cover plate 110. A manifold 122 is formed in the manifold member 101. The manifold 122 surrounds the slits 111B.

The patterns 124 and 125, formed on the cover plate 110, are connected to a wiring pattern on a flexible print board (not shown). The wiring pattern on the flexible print board is connected to a rigid board (not shown) which is connected to a controller to be described later.

Figure 2:
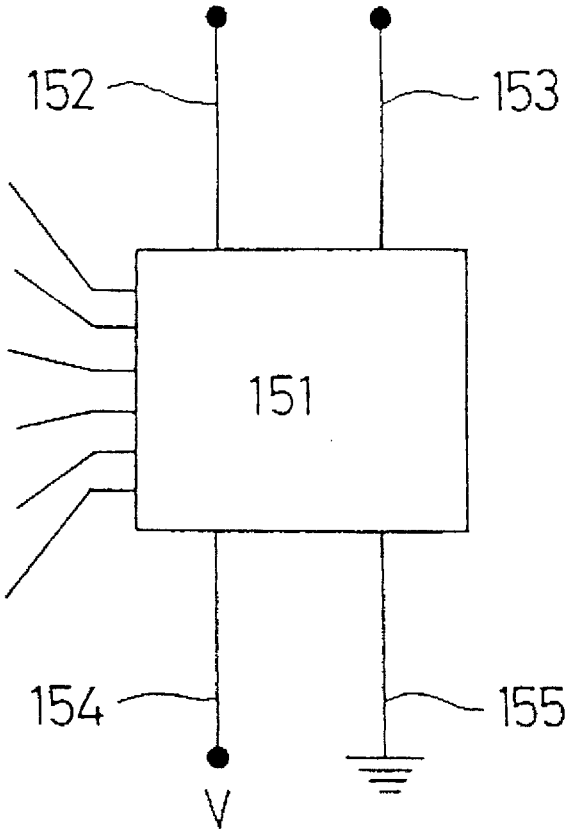
FIG. 2 is a block diagram showing a controller of the ink ejecting device of the first embodiment.

Next, the structure of the controller will be described with reference to FIG. 2. Each of the patterns 124 and 125 formed on the cover plate 110 is individually connected to an LSI chip 151 through the flexible print board and the rigid board. A clock line 152, a data line 153, a voltage line 154 and a ground line 155 are also connected to the LSI chip 151. In response to continuous clock pulses supplied from the clock line 152, the LSI chip 151 identifies a nozzle 12 from which an ink ejecting operation of ink droplet is first started on the basis of data input on the data line 153. The LSI chip 151 then applies a voltage V, from the voltage line 154 to the pattern 124 which is connected to the metal electrodes 8 of the air channels 127 at both sides of the ink channel 104 from which the ink to be ejected. Further, the LSI chip 151 connects the other patterns 124 and the pattern 125, connected to the metal electrodes 8 of the other ink channels 104, to the ground line 155.

Next, the operation of the ink ejecting device 100 will be described. In order to eject ink droplets from an ink channel 104B, shown in FIG. 3B, a voltage pulse is applied through the patterns 124 to metal electrodes 8C, 8F on the ink channel 104B side of air channels 127B and 127C, respectively located on either side of the ink channel 104B. The other metal electrodes 8 8D, 8E, and 8G (as shown) are grounded through the other patterns 124 and the pattern 125. Through this operation, an electric field in the direction indicated by arrow 113B occurs in the partition wall 106B while an electric field in the direction indicated by arrow 113C occurs in the partition wall 106C so that the partition walls 106B and 106C move to separate from each other. Accordingly, the volume of the ink channel 104B is increased, and the pressure in the ink channel 104B in the vicinity of the nozzle 12 is reduced. This state is maintained for a time represented by L/a. During this time, the ink is supplied from the manifold 122 through the slit 111B associated with ink channel 104B. L/a is the time required for the pressure wave in the ink channel 104 to propagate in one way in the longitudinal direction of an ink channel 104 (from the slit 111B to the nozzle plate 14 or in the opposite way thereto). The time is determined on the basis of the length L of the ink channel 104 and acoustic velocity a of the ink.

According to the propagation theory of a pressure wave, when the time L/a elapses from the rise-up as described above, the pressure in the ink channel 104B is inverted and varies to a positive pressure. The voltage applied to the electrodes 8C and 8F is returned to 0 V in synchronization with the timing when the pressure in the ink channel 104B is inverted and varies to a positive pressure. Through this operation, the partition walls 106B and 106C are returned to a state before deflection (FIG. 3A), and the ink is pressurized. At this time, the positively-varied pressure is added with the pressure which is generated when the partition walls 106B and 106C are returned to the state before deflection, so that a relatively-high pressure is supplied to the ink in the ink channel 104B and an ink droplet is ejected from the nozzle 12.

In the above embodiment, the driving voltage is applied so that the volume of the ink channel 104B is increased, and then the application of the driving voltage is stopped, so that the volume of the ink channel 104B is reduced to its natural state, the ink droplet is ejected from the ink channel 104B. However, it may be adopted that the driving voltage is first applied so that the volume of the ink channel 104B is reduced to eject the ink droplet from the ink channel 104B, and then the application of the driving voltage is stopped so that the volume of the ink channel 104B is increased from its reduced state to its natural state to supply the ink into the ink channel 104B.

As described above, in the ink ejecting device 100 of this embodiment, the voltage pulse is applied through one of the patterns 124 to the metal electrodes 8C and 8F on the ink channel 104B side of the air channels 127B and 127C on either side of the ink channel 104B from which the ink is to be ejected, and the other metal electrodes 8 8D, 8E, and 8G (as shown) are grounded through the other patterns 124 and the pattern 125, whereby the ink droplet is ejected from the nozzle 12 of the ink channel 104. Therefore, no voltage is applied to the metal electrodes 8 of the ink channel 104 filled with ink. As a result, there is no deterioration of the metal electrodes 8C, 8F (as shown) due to the presence of ink. Accordingly, unlike the prior art, no insulating layer for insulating the ink and the metal electrodes 8C, 8F (as shown) from each other is required and, thus, no equipment and process for the insulation are required. Therefore, production can be improved and the cost can be reduced. In addition, no voltage is applied to the metal electrodes 8D, 8E (as shown) of the ink channel 104 filled with those ink and, thus, the metal electrodes 8 have excellent anti-corrosion. Therefore, the durability of all of the metal electrodes 8 is high and the life of the ink ejecting device 100 is lengthened.

Further, the air channels 127 are filled with air and, thus, the partition walls 106 are easily deformed so that the driving voltage may be low.

In this embodiment, since the slits 111B are formed on the end surface 110B of the cover plate 110, only the ink channels 104 communicate with the manifold 122. No air channel 127 communicates with the manifold 122. Therefore, no ink is supplied to the air channels 127 and the deflection of the partition walls 106B and 106C to eject the ink droplet from the ink channel 104B has no effect on the other ink channels, such as adjacent ink channels 104A and 104C. Accordingly, the ink droplet is efficiently ejected from each ink channel 104 and a high print quality is obtained.

Further, in the ink ejecting device 100 of the embodiment, after the cover plate 110 is adhesively attached to the piezoelectric ceramic plate 102, the metal electrode 109 is formed at an area on the surface 110C of the cover plate 110 of the end surface 110A side from the bottom surface of the slit 111A and at a part of the side surface of the inner surface of the slit 111A, so that the metal electrode 8 at one side of an air channel 127 is electrically connected to the metal electrode 8 at the ink channel 104 side of another air channel 127, the ink channel 104 being sandwiched between these air channels 127. In addition, the metal electrode 117 is formed at an area on the surface 110C of the cover plate 110 extending from approximately the middle thereof to the end surface 110B side of the surface 110C, and over the entire inner surface of each slit 111B, and thus the electrodes 8 of all the ink channels 104 are electrically connected to one another.

Therefore, the metal electrodes 109 and 117 are electrically connected to the patterns 124 and 125 which are formed on the surface 110C which is a plane of the cover plate 110 and, thus, the patterns 124 and 125 and the wiring pattern of the flexible print board can be efficiently and easily electrically connected to each other. Further, the patterns 124 and 125 can be designed in a suitable shape and size to perform an accurate electrical connection.

Additionally, the patterns 124 and 125 of the cover plate 110 may be directly connected to the rigid board connected to the controller without a flexible print board.

By setting the width of the air channels 127 to be smaller than the width of the ink channels 104, the width of the piezoelectric ceramic plate 102 can be reduced.

In this embodiment, the grooves 103 are formed on one side surface of the piezoelectric ceramic plate 102. However, it may be adopted that the piezoelectric ceramic plate is designed to have a large thickness, and grooves are formed on both sides thereof to provide ink channels and air channels.

Next, a second embodiment according to the invention will be described.

Figure 4:
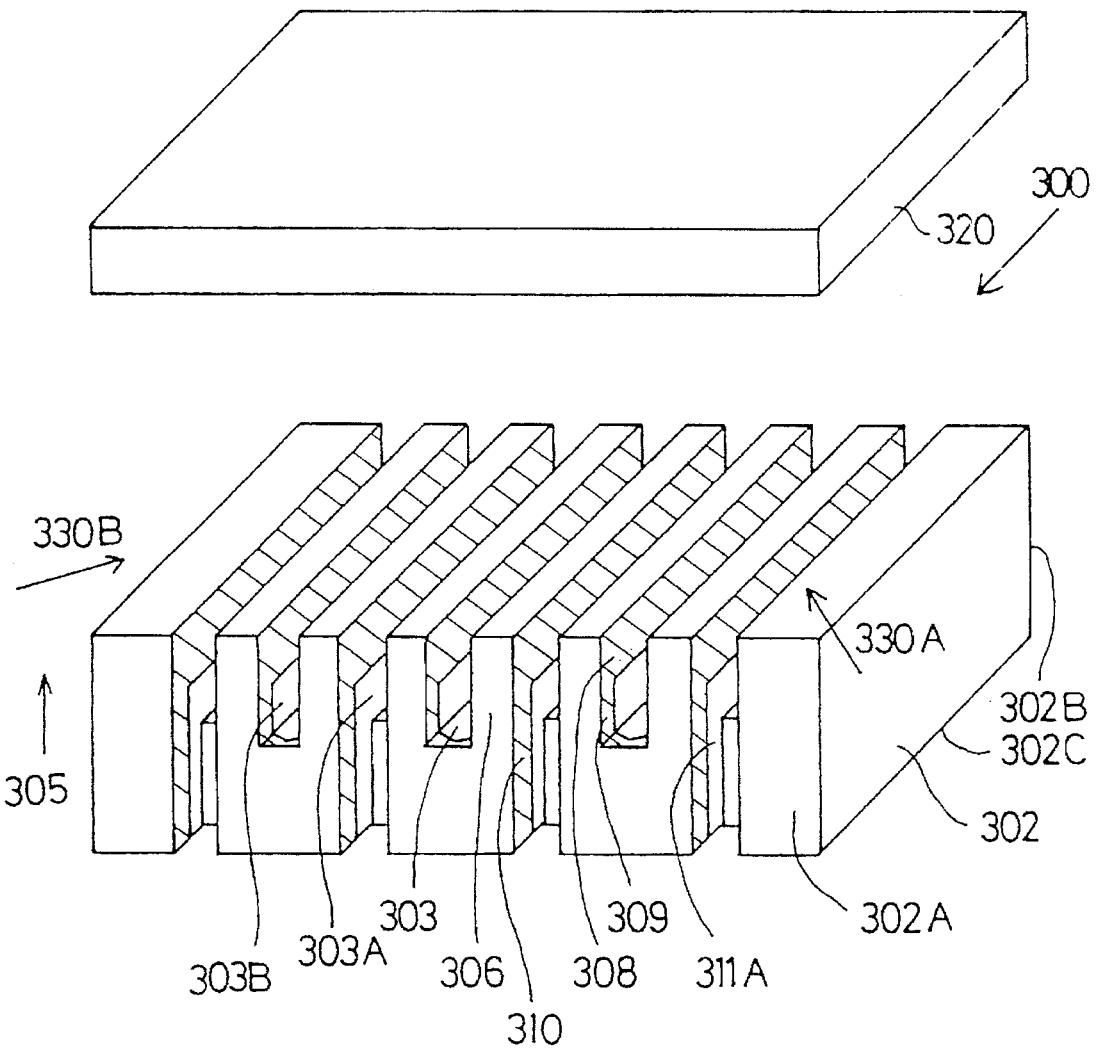
FIG. 4 is a perspective view showing an ink ejecting device of the second embodiment.
Figure 5:
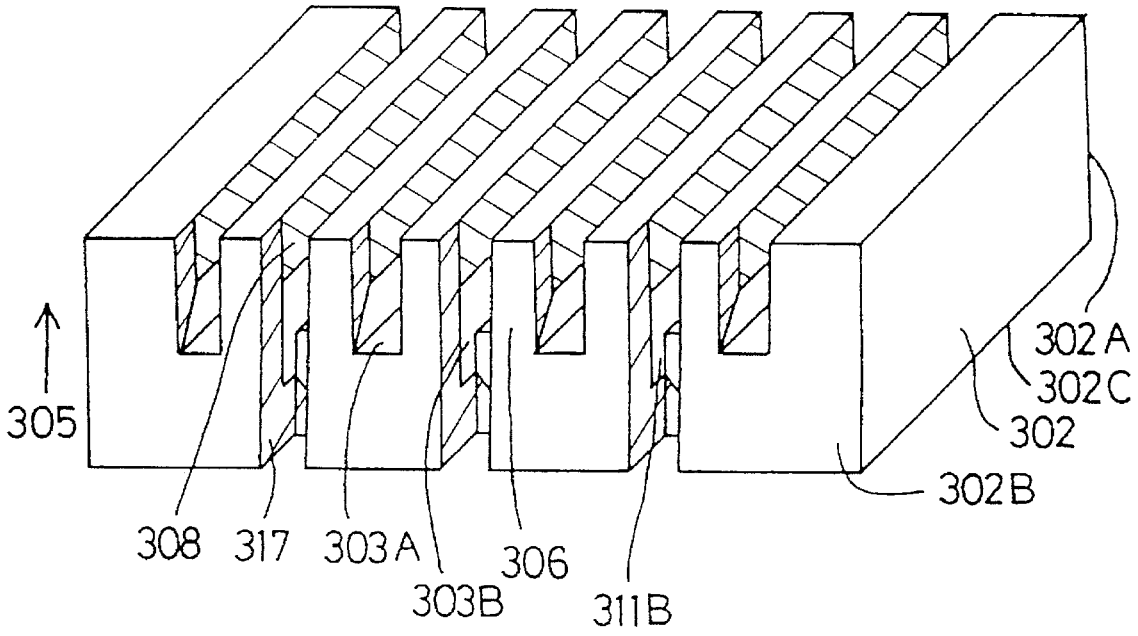
FIG. 5 is a perspective view showing a piezoelectric ceramic plate of the second embodiment.
Figure 6:
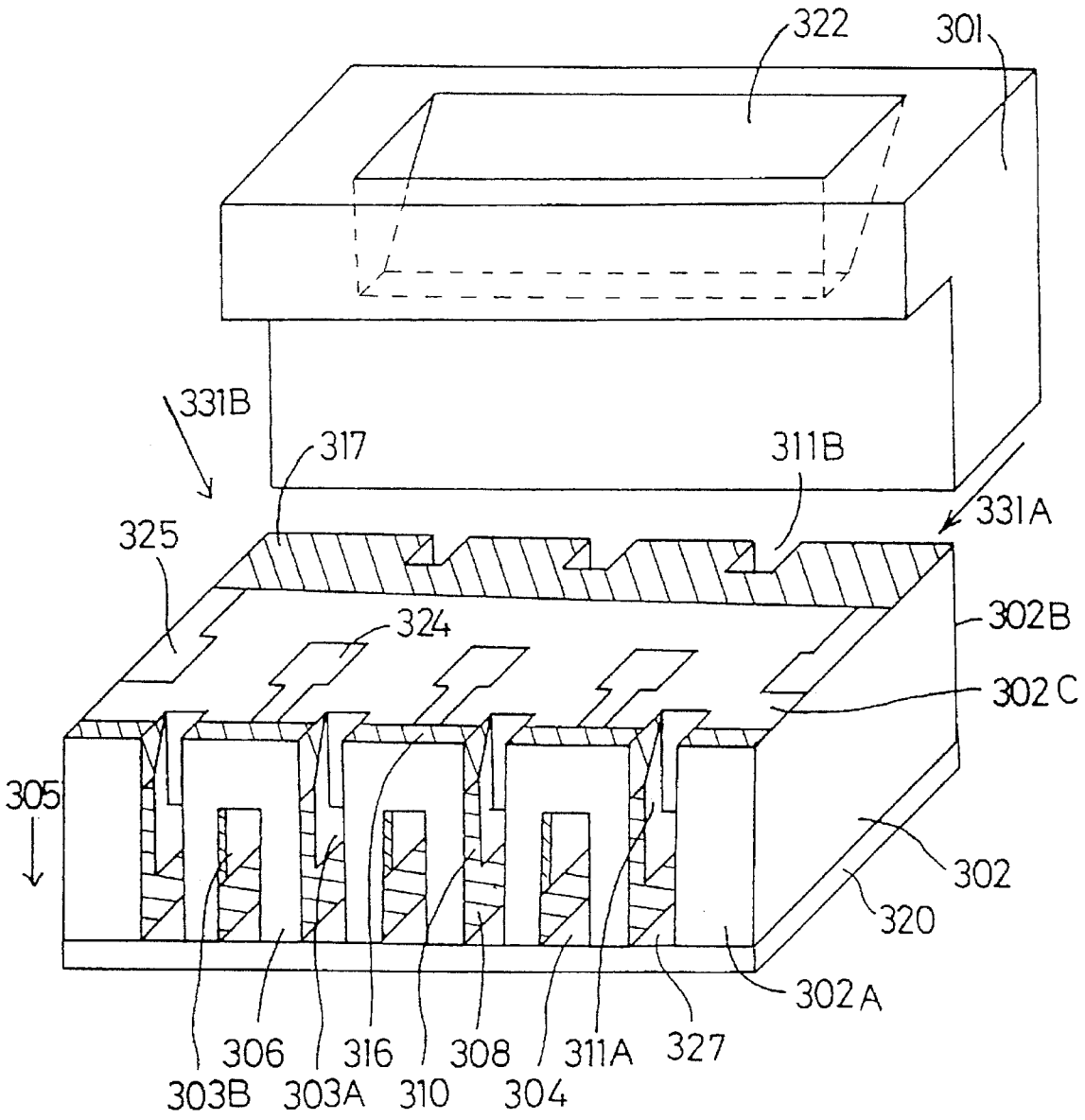
FIG. 6 is a schematic view showing the ink ejecting device of the second embodiment.

As shown in FIGS. 4, 5 and 6, an ink ejecting device 300 comprises a piezoelectric ceramic plate 302, a cover plate 320, a nozzle plate (not shown) and a manifold member 301.

The piezoelectric ceramic plate 302 is formed of ceramic material of lead zirconate titanate group (PZT). A plurality of grooves 303 are formed in the piezoelectric ceramic plate 302 by cutting using a diamond blade or the like. Partition walls 306, which serve as the side surfaces of the grooves 303, are polarized in a direction as indicated by an arrow 305. The grooves 303 are processed to the same depth and in parallel to one another so as to be open at both end surfaces 302A and 302B of the piezoelectric ceramic plate 302.

On the end surface 302A of the piezoelectric ceramic plate 302, slits 311A are formed so as to communicate with every other groove 303, and on the end surface 302B of the piezoelectric ceramic plate 302, slits 311B are formed so as to communicate with every other groove 303. The slits 311A and 311B are alternately formed, and each slit 311A and each slit 311B are formed in the neighboring grooves 303. The slits 311A are provided in the two outermost grooves 303. Further, patterns 324 and 325 are formed on the surface 302C, opposite to the side of the piezoelectric ceramic plate 302 containing the grooves 303.

Thereafter, metal electrodes 308, 309 and 310 are formed by a deposition source (not shown) located at an upper oblique position with respect to the groove-processed surface and the end surface 302A of the piezoelectric ceramic plate 302, as shown in FIG. 4 (deposited from directions as indicated by arrows 330A and 330B). In this case, a masking treatment is performed to prevent a metal electrode from being formed on the end surface 302A of the piezoelectric ceramic plate 302 and the vertex portions of the partition walls 306. Accordingly, as shown in FIG. 4, each metal electrode 308 is formed at upper half portions on both side surfaces of each groove 303, and each metal electrode 309 is formed at a part of the side surface and a part of the bottom surface at the end surface 302A side of each groove 303 having no slit 311A formed therein. Each metal electrode 310 is formed at the end surface 302A side of the side surface of each slit 311A. The metal electrodes 308 and the metal electrodes 309 of each groove 303 are electrically connected to each other, and the respective metal electrodes 308 and the metal electrodes 310 of each groove 303 are electrically connected to each other.

Thereafter, metal electrodes 316 and 317 are formed by a deposition source (not shown) located at an upper oblique position with respect to the surface 302C and the end surface 302B of the piezoelectric ceramic plate 302 (deposited from directions as indicated by arrows 331A and 331B). Masking is used to prevent a metal electrode from being formed on the end surface 302B of the piezoelectric ceramic plate 302 and an area on the surface 302C of the piezoelectric ceramic plate 302 on which the patterns 324 and 325 are formed. Accordingly, as shown in FIG. 6, each metal electrode 316 is formed in an area on the surface 302C of the end surface 302A side and from the bottom surface of each slit 311A along a part of the side surface of the inner surface of each slit 311A. At this time, the metal electrodes 316 are formed on the metal electrodes 310 formed in the slits 311A, so that the metal electrodes 316 formed on the side surfaces of the slits 311A are electrically connected to the metal electrodes 308 through the metal electrodes 310. Therefore, a metal electrode 308 formed on a partition wall 306 which is located at one side of a groove 303 having a slit 311A formed therein is electrically connected to a metal electrode 308 formed on another partition wall 306 which is located in another groove 303A, the two partition walls 306 defining the groove 303B therebetween. Further, each metal electrode 316 is electrically connected to a pattern 324.

As shown in FIGS. 5 and 6, the metal electrode 317 is formed at the area from approximately the middle of the surface 302C of the piezoelectric ceramic plate 302 to the end surface 302B side thereof and over the entire inner surface of the slits 311B. The metal electrodes 317 are formed on the metal electrodes 308 of the grooves 303B intercommunicating with the slits 311B so that the electrodes 308 are electrically connected to the metal electrodes 317 formed on the side surfaces of the slits 311B. Therefore, the metal electrodes 308 of all the grooves 303B in which the slits 311B are formed are electrically connected to the metal electrode 317. Further, the metal electrode 317 is electrically connected to the patterns 325.

Next, the cover plate 320, which is formed of alumina, and the surface of the piezoelectric ceramic plate 302, in which the grooves 303 are cut, are adhesively attached with adhesive agent of epoxy group (not shown). Accordingly, in the ink ejecting device 300, the upper surfaces of the grooves 303 are covered and ink channels 304 intercommunicating with the slits 311B and the air channels 327 serving as non-ejecting areas intercommunicating with the slits 311A are constructed. The ink channels 304 correspond to the grooves 303B and the air channels 327 correspond to the grooves 303A. The ink channels 304 and the air channels 327 have a narrow shape with a rectangular cross-section. The ink channels 304 are filled with ink and the air channels 327 are filled with air.

A nozzle plate (not shown), provided with nozzles (not shown) at the positions corresponding to the positions of the respective ink channels 304, is adhesively attached to the end surface 302A of the piezoelectric ceramic plate 302 and the end surface of the cover plate 320. The nozzle plate is formed of a plastic material such as polyalkylene (for example, ethylene) terephthalate, polyimide, polyether imide, polyether ketone, polyether sulfone, polycarbonate, cellulose acetate or the like.

A manifold member 301 is adhesively attached to the end surface 302B of the piezoelectric ceramic plate 302 and the slit 311B side of the surface 302C of the piezoelectric ceramic plate 302. The manifold member 301 is formed with a manifold 322 and the manifold 322 surrounds the slits 311B.

The patterns 324 and 325 formed on the surface 302C of the piezoelectric ceramic plate 302 are connected to a wiring pattern of a flexible print board (not shown). The wiring pattern of the flexible print board is connected to a rigid board (not shown) connected to a controller as described later.

The same effect as in the first embodiment can be also obtained in the above construction of the second embodiment.

A third embodiment according to the invention will be described hereunder with reference to the accompanying drawings.

Figure 7:
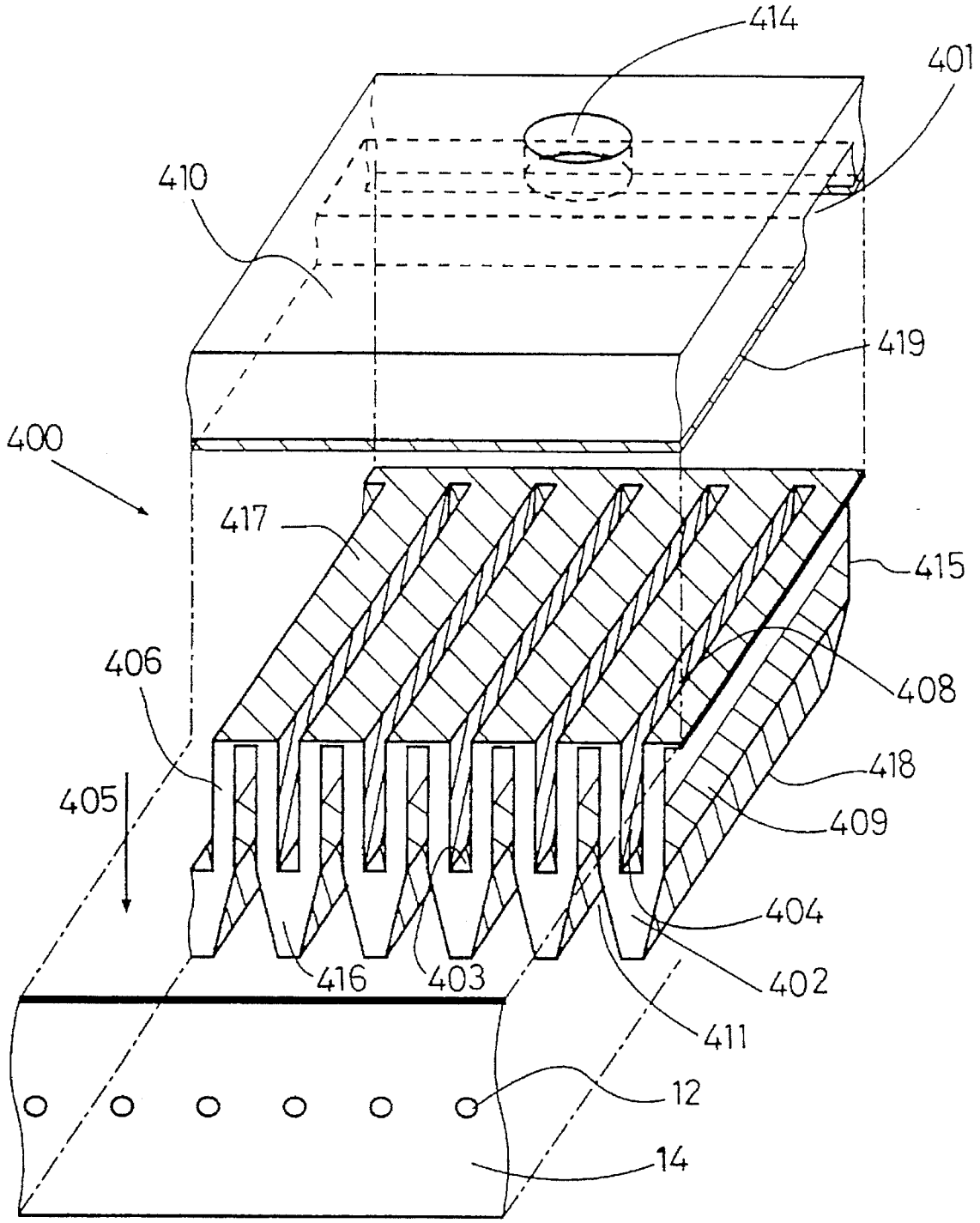
FIG. 7 is a perspective view showing an ink ejecting device of the third embodiment.

The structure of the ink ejecting device and a manufacturing method thereof will be described. As shown in FIG. 7, the ink ejecting device 400 comprises a piezoelectric ceramic plate 402, a cover plate 410 and a nozzle plate 14.

The piezoelectric ceramic plate 402 is formed of ceramic material such as lead zirconate titanate (PZT) and is polarized in a direction as indicated by arrow 405. The piezoelectric ceramic plate 402 is subjected to cutting from the surface 417 by a diamond blade or the like so that a plurality of grooves 403, serving as first grooves, are formed therein. The grooves 403 have the same depth and are parallel to one another. The grooves 403 are processed to be open at one end surface 416 of the piezoelectric ceramic plate 402 and are not open at the other, opposite end surface 415.

Metal electrodes 408 are formed on the whole area of the inner surfaces of the grooves 403 and the surfaces 417 by a plating method or the like.

Figure 8A:
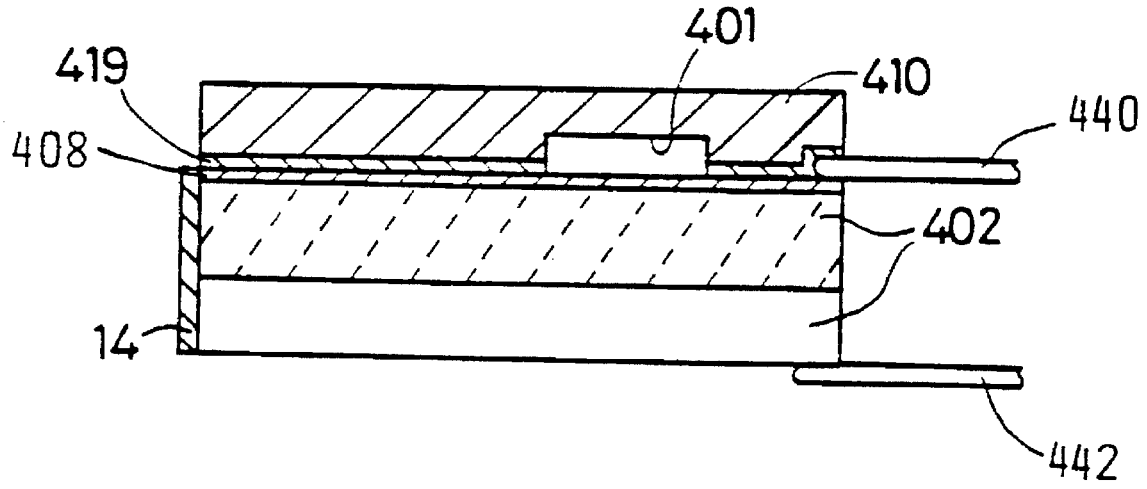
FIG. 8A is a side section of the ink ejecting device of FIG. 8.
Figure 9A:
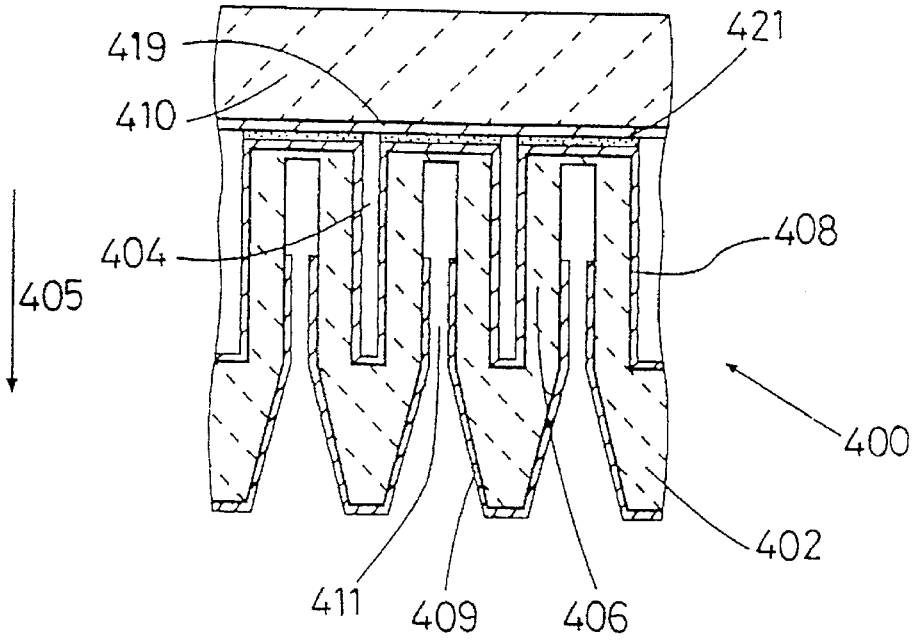
FIG. 9A is a diagram showing the operation of the ink ejecting device of the third embodiment.

The cover plate 410, formed of alumina, is provided with an ink inlet port 414 and a manifold 401. A metal electrode 419 is formed on the surface of the cover plate 410 in which the manifold is formed. The surface of the piezoelectric ceramic plate 402 which is cut to form the grooves 403 and the surface of the cover plate 410 in which the manifold 401 is formed are adhesively attached to each other with epoxy adhesive agent 421 (FIG. 9A), whereby the opening portions of the grooves 403 at the surface 417 side are covered, and ink channels 404 are formed. Most of each ink channel 404 thus formed, except for a part thereof facing the nozzle plate 14, as described later, is covered by the metal electrodes 408 and 419. At the end portion 415 side of the piezoelectric ceramic plate 402, a first flexible base plate 440 (FIG. 8A), as described later, is disposed between the piezoelectric ceramic plate 402 and the cover plate 410 to adhesively attach the piezoelectric ceramic plate 402 and the cover plate 410 to each other.

Figure 8:
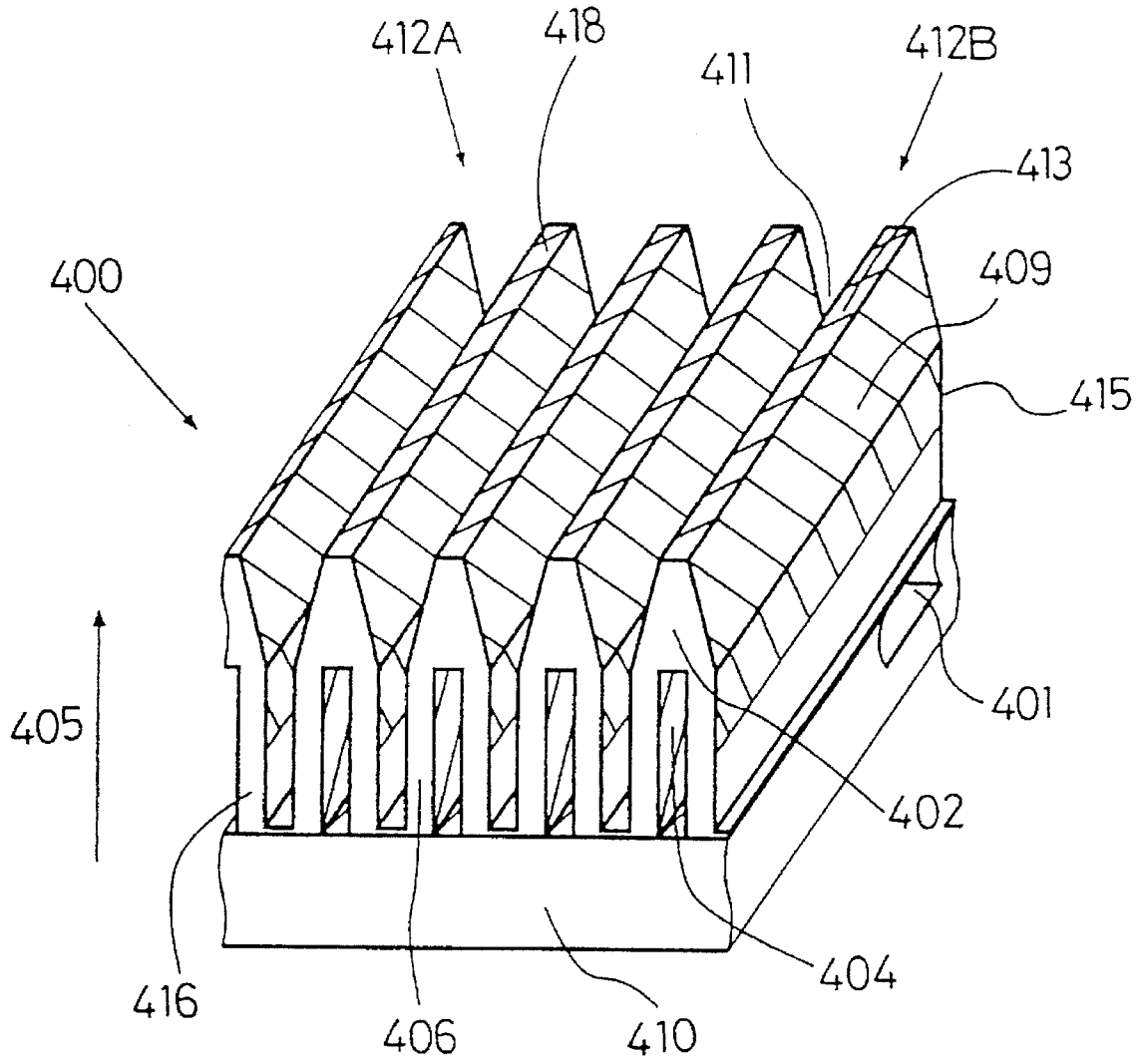
FIG. 8 is a diagram showing a manufacturing process of the ink ejecting device of the third embodiment.

After the adherence of the cover plate 410, as shown in FIG. 8, the ink ejecting device 400 is reversed, and the back surface 418 of the piezoelectric ceramic plate 402 is subject to cutting with a diamond blade or the like to form deep grooves 411 between the ink channels 404. The diamond blade for forming the deep grooves 411 is designed in a tapered form to prevent the diamond blade from being damaged due to the fineness and deepness of the cutting work. The deep grooves 411 are designed in such a depth as to extend from the back surface 418 to close to the surface 417 (FIG. 7), and to be open to both end surfaces 415,416 of the piezoelectric ceramic plate 402. Through the processing of the deep grooves 411, partition walls 406 between each deep groove 411 and ink channel 404 are formed. Each partition wall 406 is polarized in a direction as indicated by an arrow 405.

A metal electrode 409 is formed on both side surfaces of the each deep groove 411 by a sputtering method so as to extend from the back surface 418 to a substantially half height position of each ink channel 404. The sputtering is conducted from each of two directions as indicated by arrows 412A and 412B to form the metal electrodes 409 on both side surfaces of the deep grooves 411 and the back surface 418. The metal electrodes 409 thus formed cover the half areas of the outsides of the respective ink channels 404, and the metal electrodes 409 are electrically independent of one another for every ink channel 404.

Next, as shown in FIG. 7, the nozzle plate 14 is adhesively attached to end surface 416 of the piezoelectric ceramic plate 402 and the cover plate 410 with an epoxy adhesive agent or the like so that each nozzle 12 communicates with a one of the ink channels 404.

The pattern of the first flexible base plate 440 thus disposed is electrically connected to the metal electrode 408 formed on the surface 417 of the piezoelectric ceramic plate 402 and the metal electrode 419 of the cover plate 410. Each of the metal electrodes 409 formed on the back surface 418 is individually and electrically connected to the respective patterns of the second flexible base plate 442. The patterns of the first and second flexible base plates 440,442 are connected to a control unit as described later.

Next, the structure of the control unit will be described with reference to FIG. 2 which is a block diagram showing the control unit. The metal electrodes 409 (FIG. 7) are electrically and individually connected to an LSI chip 151 through the pattern of the second flexible base plate 442, and the metal electrode 408 (FIG. 7) is electrically connected to the LSI chip 151 through the pattern of the first flexible base plate 440. A clock line 152, a data line 153, a voltage line 154 and a ground line 155 are also connected to the LSI chip 151.

On the basis of sequential clock pulses supplied from the clock line 152, the LSI chip 151 judges from data input on the data line 153 which nozzle 12 should eject an ink droplet, and applies a voltage V from the voltage line 154 to a metal electrode 409 corresponding to the ink channel 404 (FIG. 7) from which the ink ejecting is to be conducted. Further, it connects the ground line 155 to the metal electrodes 409 corresponding to the ink channels 404 from which no ink ejecting is to be conducted and the metal electrode 408 in the ink channels 404.

Figure 9B:
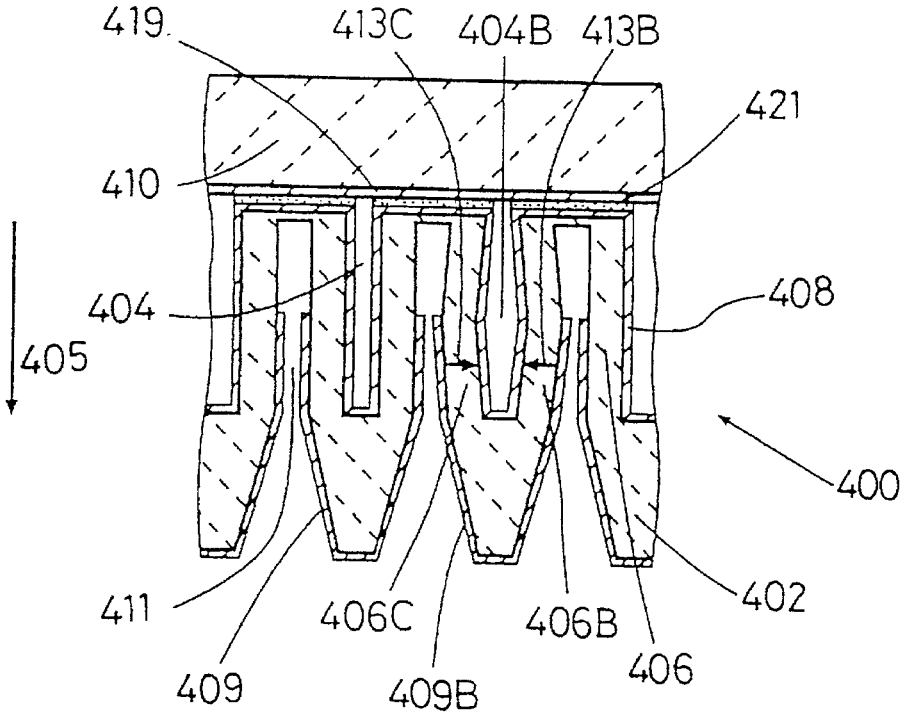
FIG. 9B is a diagram showing the operation of the ink ejecting device of the third embodiment.
Figure 10A:
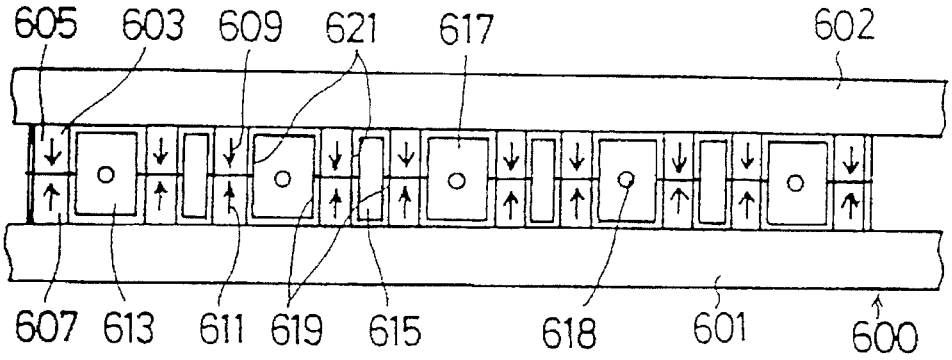
Fig.10 A RELATED ART
FIG. 10A is a schematic view showing a conventional ink ejecting device.
Figure 10B:
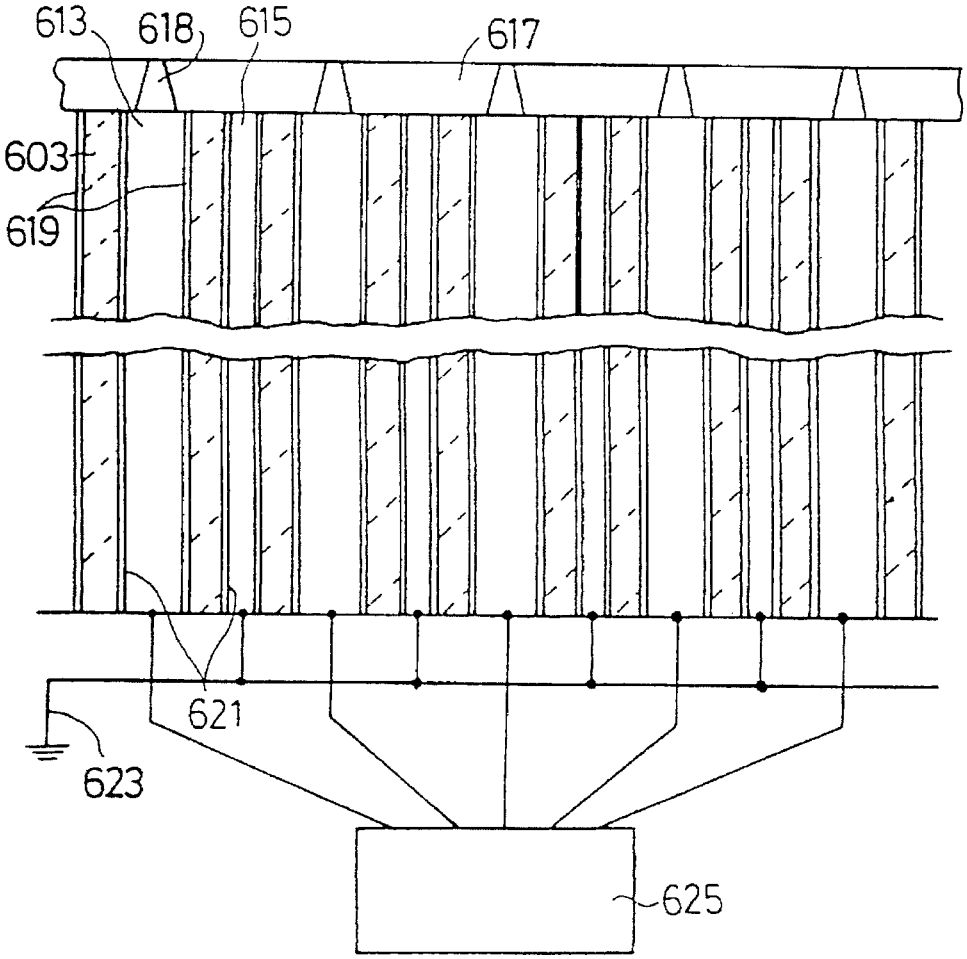
Fig.10 B RELATED ART
FIG. 10B is a schematic view showing a conventional ink ejecting device.
Figure 11:
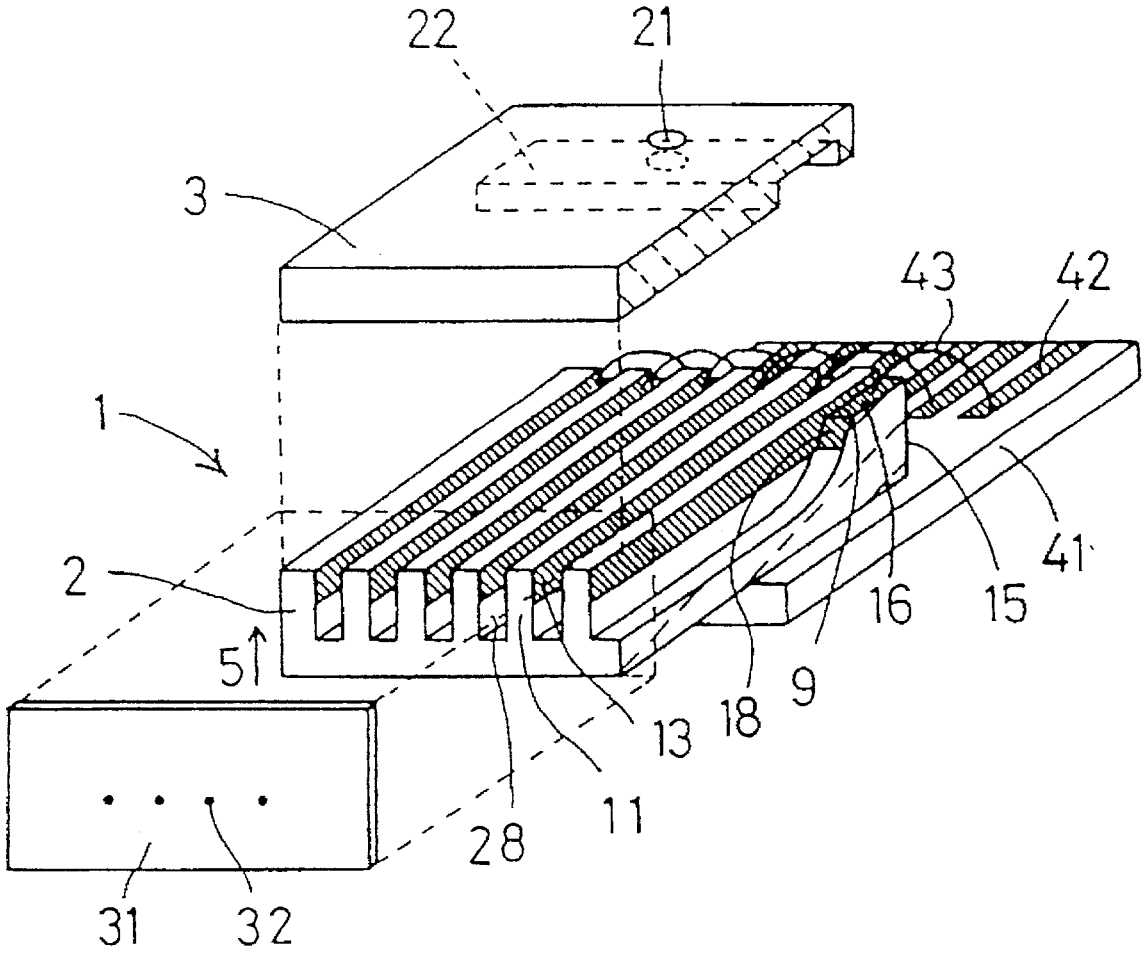
Fig.11 RELATED ART
FIG. 11 is a plan, cut away perspective view showing an ink ejecting device according to a related art.

Next, the operation of the ink ejecting device 400 of this embodiment will be described. When an ink droplet is ejected from the ink channel 404 shown in FIG. 9B, the LSI chip 151 (FIG. 2) applies a voltage pulse to a metal electrode 409B corresponding to the ink channel 404B, and connects the ground to the metal electrodes 409 corresponding to the other ink channels 404 and the metal electrode 408 in the ink channels 404. With this application, an electric field, directed in directions indicated by arrows 413B and 413C, occur between a partition wall 406B and a partition wall 406C at a portion where the metal electrode 408 and the electrode 409B face each other. As a result, the partition walls 406B and 406C are moved so as to be separated from each other as shown. At this time, an electric field also occurs at a portion lower than the bottom surface of each groove 403 (FIG. 7) of the piezoelectric ceramic plate 402, so that the piezoelectric ceramic material at a voltage-occurring portion is deformed, but the volume of the ink channel 404B is not effected by this latter electric field.

The volume of the ink channel 404B is increased by the deflection of the partition walls 406B and 406C, and the pressure in the ink channel 404B is reduced. This state is kept for a time L/a. During this time, ink is supplied from an ink supply source (not shown) through the ink inlet port 414 and the manifold 401 into the ink channel 404B. The time L/a is the time required for the pressurized liquid in the ink channel 404 to propagate one way in a longitudinal direction of the ink channel 404 (from the manifold 401 to the nozzle plate 14, or vice versa), and it is determined by the length L of the ink channel 404 and the sound velocity a of the ink.

According to the propagation theory of a pressure wave, just when the time of L/a elapses from the rise-up as described above, the pressure in the ink channel 404B is inverted and varies to a positive pressure. The voltage applied to the electrode 409B is returned to 0 V in synchronism with this timing. Through this operation, the partition walls 406B and 406C are returned to the state before deflection (FIG. 9A), and the ink is pressurized. At this time, the positively-varied pressure and the partition walls 406B and 406C returning to the state before deflection combine to generate a relatively-high pressure that is supplied to the ink in the ink channel 404B and an ink droplet is ejected from the nozzle 12 (FIG. 7).

In the above embodiment, the driving voltage is applied so that the volume of the ink channel 404B is increased, and then the application of the driving voltage is stopped so that the volume of the ink channel 404B is reduced to its natural state, thereby ejecting the ink droplet from the ink channel 404B. However, it may be adopted that the driving voltage is first applied so that the volume of the ink channel 404B is reduced to eject the ink droplet from the ink channel 404B, and then the application of the driving voltage is stopped so that the volume of the ink channel 404B is increased from the reduced state to the natural state to supply the ink into the ink channel 404B.

As described above, in the ejecting device 400 of this embodiment, the voltage pulse is applied to the metal electrode 409 corresponding to the ink channel 404B from which the ink should be ejected and the metal electrodes 408 in the ink channels 404 are grounded, whereby the ink droplet is ejected from the nozzle 12. Therefore, no voltage is applied to the metal electrodes 408 on the inner surfaces of the ink channels 404 filled with ink. Accordingly, unlike the prior art, no insulating layer for insulating the ink and the electrodes 408 in the ink channels from each other is required. Thus, no equipment and process for the insulation are required. Therefore, the production of the ink ejecting devices can be improved and the cost can be reduced. In addition, as no voltage is applied to the metal electrodes 408 in the ink channels 404 filled with the ink, the metal electrodes 408 are less subject to corrosion. Therefore, durability of the metal electrodes 408 is high and the lifetime of the ink ejecting device 400 is long.

Since air exists in the deep grooves 411, the partition walls 406 are easily deformed. Thus, the driving voltage may be small. Further, since deflection of partition walls 406C and 406D of the ink channel 404B has no effect on the other ink channels, the ink droplet is efficiently ejected from each ink channel 404 and print quality is good.

Since only the grooves 403 are opened on the surface 417 of the piezoelectric ceramic plate 402 which adheres to the surface of the cover plate 410 in which the manifold is formed, the manifold 401 for supplying the ink to the ink channels 404 corresponding to the grooves 403 may be designed in a simple shape and thus the processing work can be simply performed. Therefore, the production is simplified and the mass production is excellent.

Further, since each metal electrode 409 is exposed to the outside over the whole length of the ink ejecting direction in the longitudinal direction thereof, the electrical connection to the pattern of the flexible base plate is simply and surely performed.

Still further, since the inner surface of each ink channel 404 is substantially covered by the metal electrodes 408 and 419, no electric field invades into the ink channels 404 and thus no electric field is applied to the ink. Accordingly, no electrochemical variation of the ink due to the presence of a electric field occurs and the ink is prevented from being deteriorated.

In order to prevent invasion of dust or motes into the deep grooves 411 and to further prevent the partition walls 406 from being damaged by an external force, a reinforcing plate may be disposed on the back surface 418 of the piezoelectric ceramic plate 402. Further, it may be adopted that the pattern which is electrically connected to the metal electrodes 409 is formed on the reinforcing plate, and the metal electrodes 409 are connected to the control unit without the use of a flexible base plate. Still further, it may be adopted that no metal electrode 409 is formed on the back surface 418 of the piezoelectric ceramic plate 402, and a connector is provided to the reinforcing plate to electrically connect the metal electrodes 409 of the outer sides of the respective grooves 403.

In the above embodiment, the cover plate 410 is adhesively attached to the surface 417 of the piezoelectric ceramic plate 402, however, it may be adopted that two piezoelectric ceramic plates, each of which is provided with grooves and deep grooves corresponding to the grooves 403 and the deep grooves 411 respectively, are provided and the surfaces of the piezoelectric ceramic plates at the groove-forming sides thereof are adhesively attached to each other so that the grooves are confronted to each other.

Further, in the above embodiment, the grooves 403 and the deep grooves 411 are formed on one piezoelectric ceramic plate 402. However, it may be adopted that a ceramic material such as alumina which suffers no piezoelectric deflection is laminated on the piezoelectric ceramic, the grooves 403 are formed from the sides of the ceramic material which suffers no piezoelectric deflection, and the deep grooves 411 are formed from the piezoelectric ceramic side.

Figure 17A:
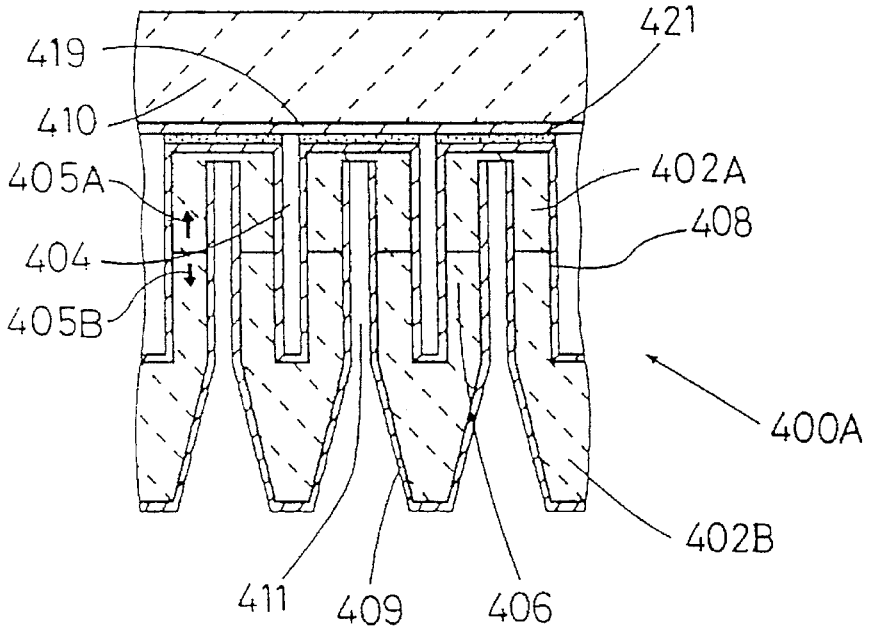
FIG. 17A is a diagram showing the operation of the ink ejecting device of a modified embodiment.
Figure 17B:
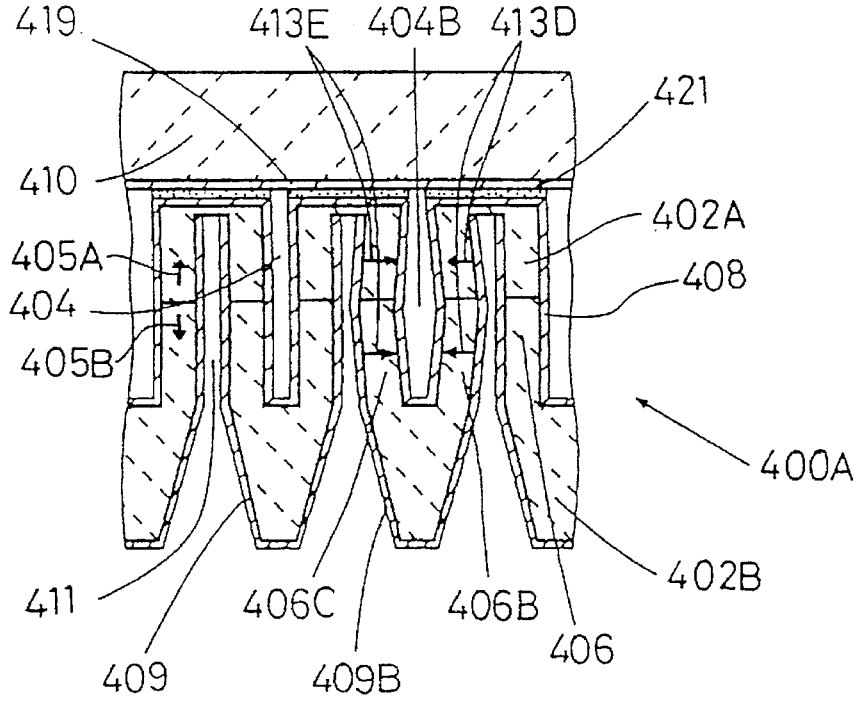
FIG. 17B is a diagram showing the operation of the ink ejecting device of a modified embodiment.

Still further, in the above embodiment, the grooves 403 and the deep grooves 411 are formed on one piezoelectric ceramic plate 402, the metal electrodes 408 are formed on the whole inner surfaces of the grooves 403 and the metal electrodes 409 are formed in the area extending from the back surface 418 to the position which is substantially half of the height of the ink channels 404 on the side surfaces of the deep grooves 411 to thereby induce a piezoelectric thickness shear-mode deflection on the partition walls 406. Further, the following modified embodiment may be adopted to the invention. The modified embodiment is explained referring to FIGS. 17A and 17B. The same numerals are provided to the elements which are the same as those of the third embodiment and the explanation of the same elements is omitted in this modified embodiment.

Two piezoelectric ceramic plates 402A and 402B are laminated on each other so that polarization directions thereof are opposite to each other. That is, the piezoelectric ceramic plate 402A is polarized in the direction 405A and the piezoelectric ceramic plate 402B is polarized in the direction 405B. The grooves 403 and deep grooves 411 are formed as previously discussed, metal electrodes 408 are formed in the whole area on the inner surfaces of the grooves 403 thereby to form ink channels 404, metal electrodes 409 are formed in the whole area on the side surfaces of the deep grooves 411. The voltage is applied to the electrode 409B and electric fields 413D and 413E are generated in the whole area of the partition walls 406B and 406C. As a result, the piezoelectric thickness shear-mode deflection is induced in both of the piezoelectric ceramic material 402A, at the upper half portion of the partition wall, and the piezoelectric ceramic material 402B, at the lower half portion of the partition wall, whereby the piezoelectric ceramic materials are deflected in the same direction and ink is drawn into and subsequently ejected from the ink channel 404B.

Figure 12:
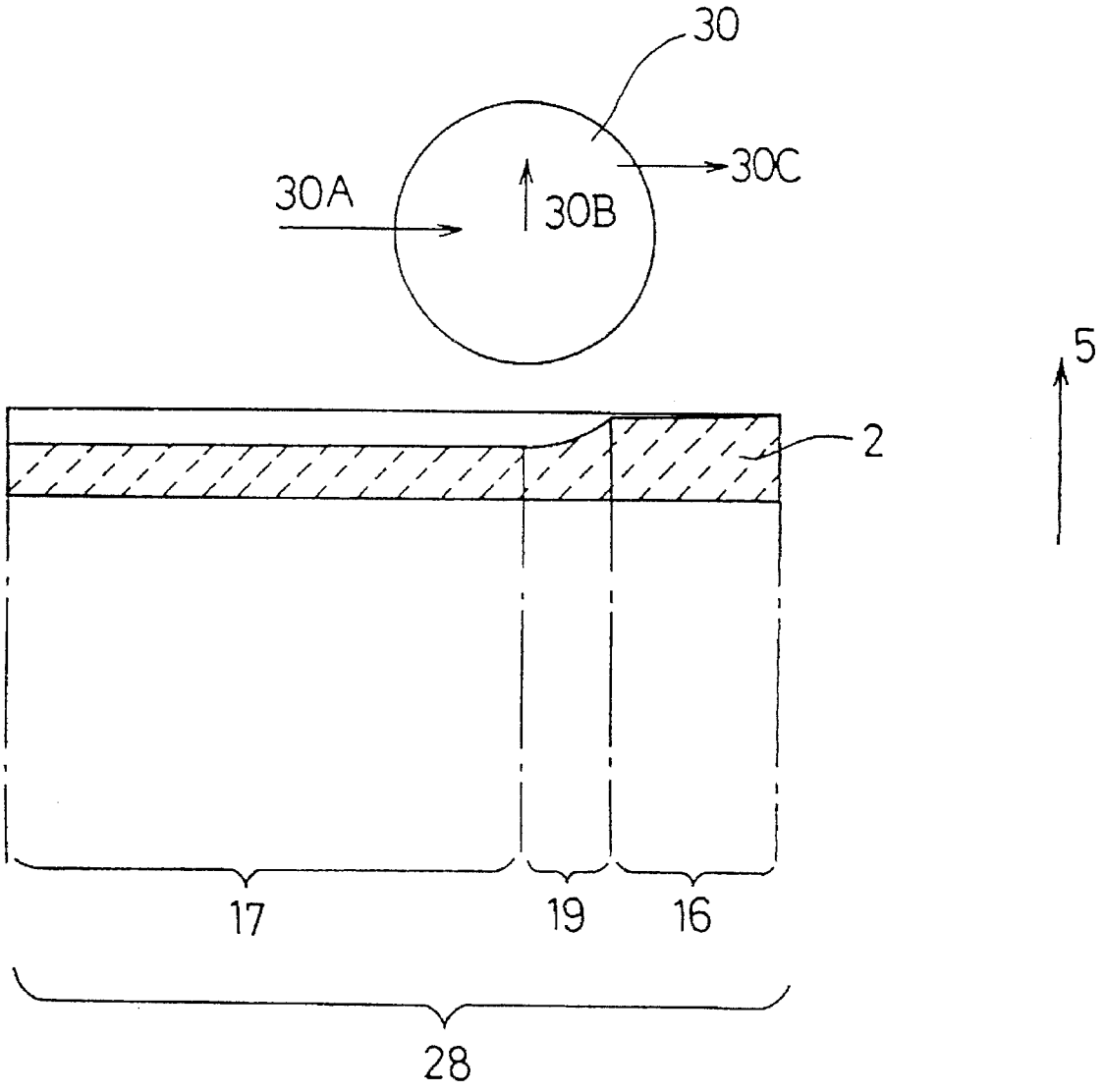
Fig.12 RELATED ART
FIG. 12 is a diagram showing a processing method for creating grooves of a related art.
Figure 13:
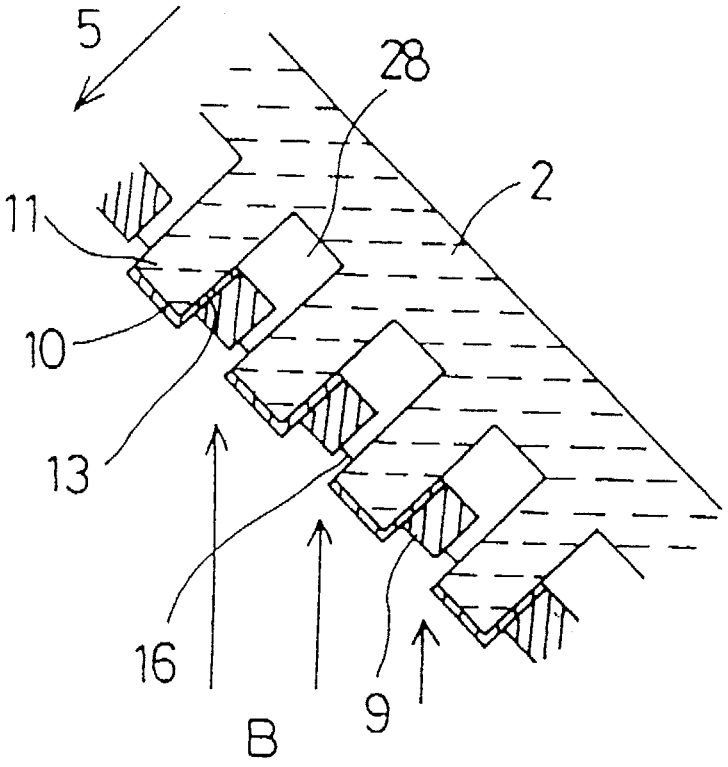
Fig.13 RELATED ART
FIG. 13 is a diagram showing a related art processing method for forming electrodes on the piezoelectric plate.
Figure 14:
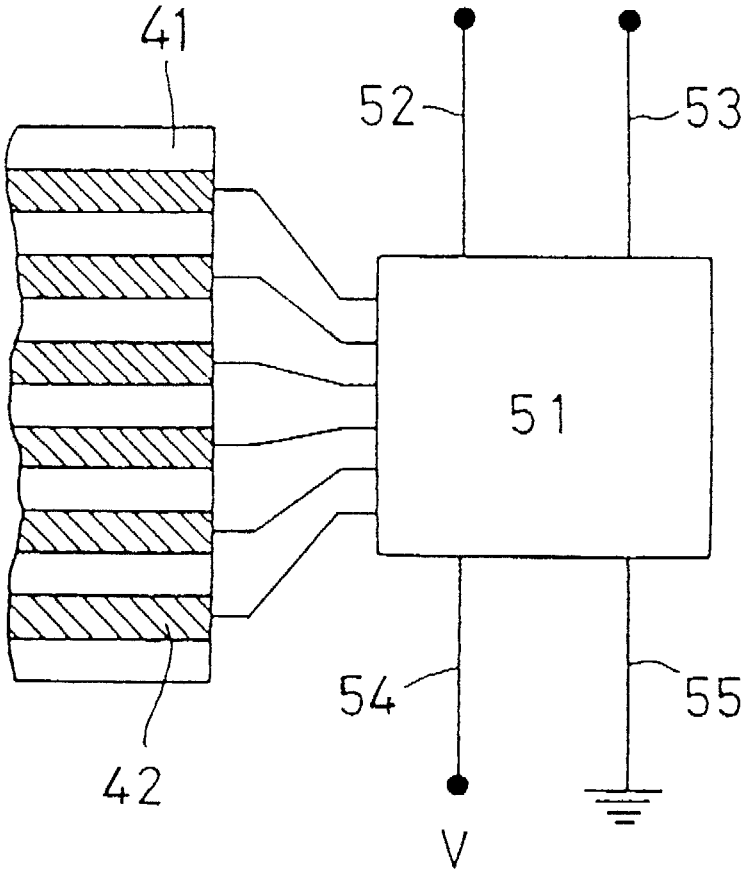
Fig.14 RELATED ART
FIG. 14 is a block diagram showing a controller of the ink ejecting device of the related art.
Figure 15:
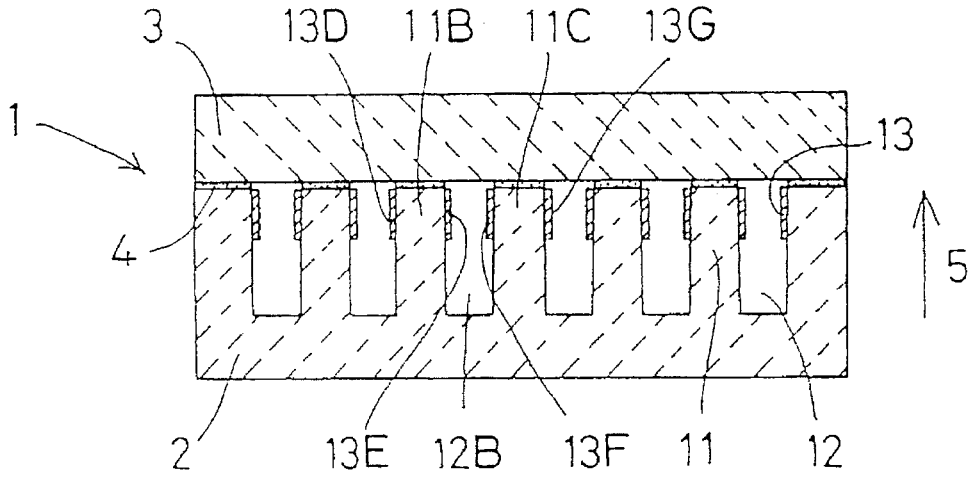
Fig.15 RELATED ART
FIG. 15 is a diagram showing the operation of the ink ejecting device of the related art.
Figure 16:
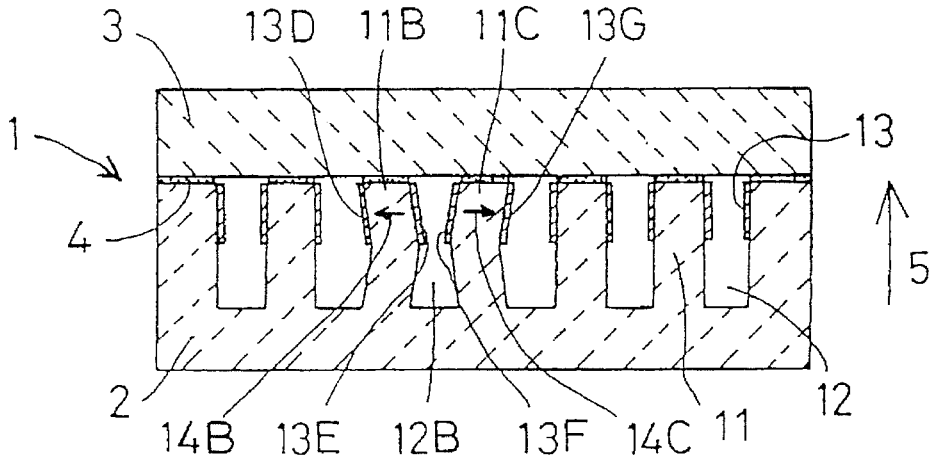
Fig.16 RELATED ART
FIG. 16 is a diagram showing the operation of the ink ejecting device of the related art.

Therefore, unlike the related art, even when the arc-shaped groove portion 19 (FIG. 12) and the shallow groove portion 16 (FIG. 12) are not provided, all the metal electrodes 8, 308, 408 of the ink channels 104, 304, 404 can be connected and the metal electrodes 8, 308, 408 of the air channels 127, 327, 111 formed at both sides of the partitions 106, 306, 406 constituting the ink channels 104, 304, 404 can be electrically connected. Accordingly, a smaller amount of material is required for the piezoelectric ceramic plate 102, 302, 402 as compared with the conventional piezoelectric ceramic plate 2 and the cost can be reduced. Further, since the metal electrodes 109, 316 and 117, 317 are electrically connected to the patterns 124, 324 and 125, 325 formed on the plane 110C, 302C which is a surface of the piezoelectric ceramic plate 110, 302, the patterns 124, 324 and 125, 325 and the wiring pattern of the flexible print board can be electrically connected to each other efficiently and easily. Still further, the electrical connection can be surely performed by suitably selecting the shape and size of the patterns 124, 324 and 125, 325.

Further, in consideration of the above driving operation of the ink ejecting device 100, 300, 400 in order to perform the ejecting of an ink droplet, a prescribed voltage is required to be applied from a driver in accordance with a signal input to the partition walls 106, 306, 406 which serve as the side surfaces of the grooves 103, 303, 403 and are formed of piezoelectric material. Electrically, the piezoelectric material constituting the partition walls 106, 306, 406 acts as a kind of capacitor. Here, electrostatic capacity (C) of the capacitor is determined by the width dimension (t) of the partition walls 106, 306, 406 of piezoelectric material, the electrode area (s) of the metal electrodes 8, 308, 408 formed on the side surfaces and the dielectric constant ($\epsilon 11^T$) of the piezoelectric material, and the following equation is satisfied:

$C=\epsilon 11^T.\epsilon 0.s/t$ ($\epsilon 0$: dielectric constant of a vacuum).

In the ink ejecting device 100, 300, 400 of the above embodiments, the length of the partition walls 106, 306, 406 of piezoelectric material substantially corresponds to the length of the conventional channel groove portion 17 (FIG. 12), and the conventional arc-shaped groove portion 19 and shallow groove portion are not formed, so that the electrode area s as described above is smaller and the electrostatic capacity C is lower than those in the conventional ink ejecting device 1. Therefore, the energy efficiency is improved over the related art.

In the first, second and third embodiments, the piezoelectric ceramic plates 102, 302, 402 are formed of ceramic material of lead zirconate titanate (PZT), and shear-mode deflection is induced to the partition walls 106, 306, 406. However, the piezoelectric ceramic plates may be formed of ceramic material of lead titanate (PT), and longitudinal-mode deflection may be induced to the partition walls to eject ink.

It is to be understood that the invention is not restricted to the particular forms shown in the foregoing embodiments. Various modifications and alternations can be made thereto without departing from the scope of the inventions encompassed by the appended claims.

What is claimed is:

1. An ink ejecting device, comprising:

a plurality of ejecting regions through which ink is ejected;

a plurality of non-ejecting regions each of which is provided between said ejecting regions alternately and which receive no ink;

a plurality of partition walls which are formed of a polarized piezoelectric ceramic material, a partition wall provided between one of said plurality of ejecting regions and one of said plurality of non-ejecting regions; and an electrode formed on a side of each partition wall of said plurality of partition walls facing an ejection region of said plurality of ejecting regions is grounded and an electrode formed on a side of each partition wall of said plurality of partition walls facing a non-ejecting region of said plurality of non-ejecting regions is supplied with a voltage from a voltage source when ink is to be ejected, wherein two partition walls of said plurality of partition walls bound each ejecting region, each said electrode formed on the side of each partition wall facing into one of said plurality of ejecting regions electrically connected to each other electrode formed on the side of each partition wall facing into one of said plurality of ejecting regions and grounded, and at least one pair of two partition walls of said plurality of partition walls having said electrode formed on each partition wall of said plurality of partition walls facing into said plurality of non-ejecting regions bound sides of one ejecting region, each said electrode on each partition wall of said pair of two partition walls are electrically connected to each other and supplied with the voltage.

2. The ink ejecting device as claimed in claim 1, wherein the piezoelectric ceramic material forming said plurality of partition walls has a direction of polarization and a direction of an electronic field generated in the piezoelectric ceramic material is perpendicular to the direction of polarization.

3. The ink ejecting device as claimed in claim 1, further comprising a connecting electrode electrically connecting said electrode formed on a side of each partition wall of said plurality of partition walls facing an ejecting region.

4. An ink ejecting device, comprising:

a plurality of ink channels;

a plurality of partition walls forming walls of said ink channels, at least a portion of said partition walls formed of a piezoelectric ceramic material;

a plurality of first electrodes formed on the piezoelectric ceramic material of said partition walls;

a first plurality of slits, each slit communicates with an associated ink channel of said plurality of ink channels;

a plurality of second electrodes provided on a portion of said first plurality of slits, said second electrodes being electrically connected to said first electrodes provided on the piezoelectric material facing said ink channels;

a first plate of a piezoelectric ceramic material;

a plurality of grooves formed on one surface of said first plate, said partition walls being formed for each of said grooves;

a second plate provided on said first plate so as to close said grooves to form said ink channels;

a third electrode formed on another surface of said first plate opposite to the one surface and adjacent to said first plurality of slits, wherein said first plurality of slits are provided in said first plate;

a plurality of non-ejecting channels provided so as to place a non-ejecting channel on each side of each one of said ink channels;

a second plurality of slits provided in said first plate, each slit of said second plurality of slits communicating with an associated non-ejecting channel; and a plurality of fourth electrodes provided on a portion of inner surfaces of each said slit of said second plurality of slits and on a portion adjacent to said second plurality of slits on said another surface of said first plate, said fourth electrodes being electrically connected to said first electrodes provided on the piezoelectric ceramic material facing said non-ejecting channels.

5. The ink ejecting device as claimed in claim 4, wherein said plurality of slits are provided along one edge of said first plate and said plurality of second slits are provided along another edge of said first plate which is an opposite edge to the one edge, ink is supplied to only the ink channels through said plurality of slits.

6. The ink ejecting device as claimed in claim 4, wherein all of said first electrodes provided in said ink channels are electrically connected to each other through said second electrodes which are electrically connected to said third electrode and are grounded, a first electrode provided on a wall of the piezoelectric ceramic material in each non-ejecting channel of a pair of said non-ejecting channels, said non-ejecting channel, of the pair of non-ejecting channels, on each side of each ink channel are electrically connected to each other by said fourth electrodes and a voltage is applied from a volatage source to said first electrodes in said non-ejecting channels, whereby ink is ejected from said ink channels.

7. The ink ejecting device as claimed in claim 4, wherein the piezoelectric ceramic material forming said partition walls has a direction of polarization and a direction of an electric field generated in the piezoelectric ceramic material that is perpendicular to the direction of polarization.

8. An ink ejecting device, comprising:

a first plate at least a part of which is formed of a piezoelectric ceramic material;

a plurality of first grooves for receiving and ejecting ink formed in one surface of said first plate;

a second plate provided on the one surface of said first plate;

a plurality of first electrodes formed on at least a portion of side surfaces of said plurality of first grooves;

a plurality of second grooves that do not receive ink formed in another surface of said first plate opposite to the one surface of said first plate such that a second groove of said plurality of second grooves is alternately on each side of each first groove of said plurality of first grooves;

a plurality of second electrodes which are formed on at least a portion of side surfaces of said plurality of second grooves;

a third electrode for electrically connecting all of said first electrodes in said first grooves; and connection means for individually and electrically connecting pairs of said second electrodes formed on at least the portion of side surfaces of said plurality of second grooves, a second groove on each side of each one of said first grooves, a side of each second groove closest to and on either side of each first groove of said plurality of first grooves being one of a pair of the pairs of second electrodes.

9. The ink ejecting device as claimed in claim 8, further comprising a manifold provided on a first surface of said second plate, said manifold for supplying ink to said plurality of first grooves.

10. The ink ejecting device as claimed in claim 9, wherein a voltage is applied from a voltage source to said plurality of second electrodes and said plurality of first electrodes are grounded, thereby deforming the piezoelectric ceramic material on the side surfaces of said plurality of first grooves, whereby the ink supplied from said manifold is ejected from said first grooves.

11. The ink ejecting device as claimed in claim 8, wherein said third electrode is formed on the one surface of said first plate, and said connection means is a plurality of electrodes formed on the second surface of said piezoelectric ceramic plate.

12. The ink ejecting device as claimed in claim 8, wherein each of said plurality of first electrodes is formed in a whole surface of each of said plurality of first grooves, each of said plurality of second grooves is formed to have a depth extending to a portion adjacent to the first surface of said piezoelectric ceramic plate, and each of said plurality of second electrodes is formed in an area extending from the second surface of said piezoelectric ceramic plate to a point that substantially corresponds to a middle portion in depth of each of said plurality of first grooves.

13. The ink ejecting device as claimed in claim 8, wherein said piezoelectric ceramic plate comprises two plates formed of a piezoelectric ceramic material each of which is polarized in an opposite direction, the two plates laminated to each other, said plurality of first electrodes are formed in whole inner surfaces of said first grooves, said second grooves having a depth extending to a portion adjacent to the first surface of said piezoelectric ceramic plate, and said second electrodes are formed in a whole area of the side surfaces of said second grooves.

14. The ink ejecting device as claimed in claim 8, wherein a conductive film is formed on the first surface of said cover plate facing the first surface of said piezoelectric ceramic plate.

15. The ink ejecting device as claimed in claim 8, wherein the piezoelectric ceramic material between said first and second grooves has a direction of polarization and a direction of an electric field generated in the piezoelectric ceramic material is perpendicular to the direction of polarization.

16. An ink ejecting device, comprising:

a plurality of ink channels;

a plurality of non-ejecting channels, a non-ejecting channel on each side of an ink channel;

a plurality of partition walls forming walls of said ink channels and said non-ejecting channels, at least a portion of said partition walls formed of a piezoelectric ceramic material;

a plurality of first electrodes formed on the piezoelectric ceramic material of said partition walls;

a first plurality of slits, each slit communicates with an associated ink channel of said plurality of ink channels;

a plurality of second electrodes provided on a portion of said first plurality of slits, said second electrodes being electrically connected to said first electrodes provided on the piezoelectric material facing said ink channels;

a first plate of a piezoelectric ceramic material;

a plurality of grooves formed on one surface of said first plate, said partition walls being formed for each of said grooves;

a second plate provided on said first plate so as to close said grooves to form said ink channels and said non-ejecting channels;

a third electrode formed on a surface of said second plate and adjacent to said first plurality of slits, said third electrode being electrically connected through said second electrodes to said first electrodes provided on the piezoelectric ceramic material facing one of said ink channels, wherein said first plurality of slits are formed in said second plate;

a second plurality of slits provided in said second plate, each slit of said second plurality of slits communicating with an associated non-ejecting channel of said non-ejecting channels; and a plurality of fourth electrodes, each fourth electrode provided on a portion of inner surfaces a slit of said second plurality of slits and on a portion adjacent to said slit of said second plurality of slits on the surface of said second plate, each said fourth electrode being electrically connected to a pair of first electrodes provided on the piezoelectric ceramic material facing said non-ejecting channels on opposite sides of a ink channel.

17. The ink ejecting device as claimed in claim 16, wherein said first plurality of slits are provided along one edge of said first plate and said second plurality of slits are provided along another edge of said first plate which is an opposite edge to the one edge, ink is supplied to only the ink channels through said first plurality of slits.

18. The ink ejecting device as claimed in claim 16, wherein all of said first electrodes provided in said ink channels are electrically connected to each other through said second electrodes which are electrically connected to said third electrode and are grounded, a first electrode provided on a wall of the piezoelectric ceramic material in each non-ejecting channel of a pair of said non-ejecting channels, a non-ejecting channel of the pair of non-ejecting channels on each side of each ink channel electrically connected to each other by said fourth electrodes and a voltage is applied from a voltage source to said first electrodes in said non-ejecting channels, whereby ink is ejected from said ink channels.

19. An ink ejecting device, comprising:

a plurality of ejecting channels through which ink is ejected;

a plurality of non-ejecting channels, a non-ejecting channel alternately provided between said ejecting channels;

a plurality of partition walls forming walls of said ejecting channels and said non-ejecting channels, at least a portion of said partition walls formed of a piezoelectric ceramic material;

a plurality of first electrodes formed on the piezoelectric ceramic material of said partition walls;

a plurality of first slits, each first slit communicating with an associated ink channel of said plurality of ink channels;

a plurality of second electrodes provided on a portion of said plurality of first slits, said second electrodes being electrically connected to said first electrodes provided on the piezoelectric material facing said ejecting channels;

a plurality of second slits, each second slit communicating with an associated non-ejecting channel of said non-ejecting channels; and a plurality of third electrodes provided on a portion of each said slit of said second plurality of slits, said third electrodes being electrically connected to said first electrodes provided on the piezoelectric ceramic material facing said non-ejecting channels.

20. The ink ejecting device as claimed in claim 19, further comprising:

a fourth electrode formed adjacent to said plurality of first slits and connected to said plurality of second electrodes; and a plurality of fifth electrodes formed adjacent to said plurality of second slits and connected to said plurality of third electrodes.

21. The ink ejecting device as claimed in claim 19, further comprising:

a first plate of a piezoelectric ceramic material, a plurality of grooves formed on one surface of said first plate, said partition walls being formed for each of said grooves; and a second plate provided on said first plate so as to close said grooves to form said ejecting channels and non-ejecting channels, wherein said plurality of first slits are provided along one edge of said first plate and said plurality of second slits are provided along another edge of said first plate which is an opposite edge to the one edge, ink is supplied to only the ejecting channels through said plurality of first slits.

22. The ink ejecting device as claimed in claim 21, wherein all of said first electrodes provided in said ejecting channels are electrically connected to each other through said second electrodes which are electrically connected to said fourth electrode and are grounded, a first electrode provided on a wall of the piezoelectric ceramic material in each non-ejecting channel of a pair of said non-ejecting channels, a non-ejecting channel of the pair of non-ejecting channels on each side of each ejecting channel are electrically connected to each other by said fifth electrode and when a voltage is applied to said first electrodes in said non-ejecting channels by a voltage source, ink is ejected from said ejecting channels.

23. The ink ejecting device as claimed in claim 1, wherein said partition walls are deformed toward the non-ejecting channels by an electric field generated by a source of electric current in said piezoelectric ceramic material for ejecting ink.

* * * * *